US007048134B1

(12) United States Patent
Hagan

(10) Patent No.: US 7,048,134 B1
(45) Date of Patent: May 23, 2006

(54) CONTAINER

(75) Inventor: John A. Hagan, Valley Forge, PA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/618,500

(22) Filed: Jul. 18, 2000

(51) Int. Cl.
*B65D 6/18* (2006.01)

(52) U.S. Cl. ..... 220/6

(58) Field of Classification Search ..... 220/6, 220/7, 9.4, 23.91
See application file for complete search history.

(56) References Cited

U.S. PATENT DOCUMENTS

| | | | | |
|---|---|---|---|---|
| 2,395,542 | A * | 2/1946 | Fordon | 220/7 X |
| 3,796,342 | A * | 3/1974 | Sanders et al. | 220/7 X |
| 3,973,692 | A * | 8/1976 | Cloyd | 220/7 |
| 4,796,788 | A | 1/1989 | Bond | |
| 4,820,383 | A * | 4/1989 | Shchamorov et al. | 220/6 |
| 5,163,587 | A | 11/1992 | Apps et al. | |
| 5,474,197 | A | 12/1995 | Hillis et al. | |
| 5,555,996 | A | 9/1996 | Lang-Ree et al. | |
| 5,556,658 | A | 9/1996 | Raudalus et al. | |
| 5,619,841 | A | 4/1997 | Muise et al. | |
| 5,622,276 | A | 4/1997 | Simmons | |
| 5,671,858 | A * | 9/1997 | Hsu | 220/9.4 X |
| 5,702,001 | A * | 12/1997 | Russell | 220/9.4 X |
| 5,967,322 | A | 10/1999 | Apps et al. | |
| 6,015,056 | A | 1/2000 | Overholt et al. | |
| 6,082,571 | A | 7/2000 | Avery | |
| 6,098,827 | A | 8/2000 | Overholt et al. | |

FOREIGN PATENT DOCUMENTS

| | | |
|---|---|---|
| EP | 0 705 764 A2 | 4/1996 |
| WO | WO 97/49613 | 12/1997 |

* cited by examiner

*Primary Examiner*—Stephen Castellano
(74) *Attorney, Agent, or Firm*—Brooks Kushman P.C.

(57) ABSTRACT

A container adapted to receive an inner receptacle is provided. The container includes a base for supporting a lower portion of the inner receptacle, where the base includes a peripheral frame portion defining at least one relatively large opening therebetween. A first pair of opposed walls extends upwardly from the peripheral frame portion, and a second pair of opposed walls extends upwardly from the peripheral frame portion and is attached to the first pair of opposed walls. As assembled, the first and second pairs of opposed walls and the base define a compartment area for receiving the inner receptacle therein.

26 Claims, 24 Drawing Sheets

CONTAINER

TECHNICAL FIELD

This invention relates to a container for storing and transporting produce items and other goods.

BACKGROUND ART

Various containers are used for transporting produce from the fields where they are grown to the markets where they are purchased. Such containers are often constructed of cardboard since this material is disposable, lightweight, and inexpensive. Unfortunately, cardboard containers tend to degrade when in contact with moisture and lack structural strength and durability. Cardboard containers also have difficulty withstanding top load forces applied to the walls of the container. Further, cardboard containers do not provide the ventilation required by most produce. Plastic containers, on the other hand, are also lightweight and inexpensive, are able to withstand a range of environmental conditions, provide structural strength even when designed for proper ventilation, and are reusable.

Although plastic containers offer many advantages over conventional cardboard containers, the disposability of cardboard is sometimes preferred if dirt and other foreign matter is encountered during the harvesting, shipping, or handling processes. For example, a container that is used for picking produce in the field may accumulate dirt from contact with the produce as well as from sitting on the ground during loading. This dirt is then transported with the container as it is shipped to the eventual retailer. If a cardboard container is used, the dirty container can simply be discarded and recycled once the produce is unloaded. If a plastic container is utilized, the dirty container is typically rinsed after unloading the produce to ensure that the container is clean and ready to reuse.

Regardless of whether cardboard or plastic containers are used, produce may often become damaged in transit from the fields to the market. Certain produce items may require special handling because of their shape, their ventilation requirements, or their capacity to be bruised. Unfortunately, one type of container is often used to transport all different kinds of produce items, such that the more delicate produce may be subject to less than ideal handling and transport conditions. Such inadequate conditions can lead to a decrease in the shelf life, appearance, and freshness of the transported products. Alternatively, different containers could be provided for different types of produce, but that is neither a practical nor cost-efficient solution.

In addition, current containers are often not well suited for displaying their contents, particularly at the point of sale. The task of investigating the contents of a particular container is even more arduous in a situation where the containers are stacked upon each other. Under these circumstances, the containers must typically be unstacked in order to identify their contents.

DISCLOSURE OF INVENTION

Therefore, it is an object according to the present invention to provide a container which combines the strength and durability of reusable containers with the cleanliness and convenience afforded by disposable containers.

It is another object according to the present invention to provide a container which provides adequate protection and ventilation for the goods contained therein which is also lightweight.

It is a further object according to the present invention to provide a container that can be customized according to the contents contained therein.

It is still another object according to the present invention to provide a container that provides enhanced visibility of the contents stored therein, as well as easier and more efficient access to the contents.

Accordingly, a container is provided which is adapted to receive an inner receptacle therein. The container includes a base for supporting a lower portion of the inner receptacle, where the base includes a peripheral frame portion defining at least one relatively large opening therebetween. A first pair of opposed walls extends upwardly from the peripheral frame portion, and a second pair of opposed walls extends upwardly from the peripheral frame portion and is attached to the first pair of opposed walls. As assembled, the first and second pairs of opposed walls and the base define a compartment area for receiving the inner receptacle therein.

The peripheral frame portion includes an inwardly extending flange for supporting the lower portion of the inner receptacle. In addition, the base can include a base member extending across the relatively large opening defined by the peripheral frame portion. In one embodiment, the base member includes at least one cross-member attached to the peripheral frame portion. In another embodiment, the base member includes an exterior ring and a lightweight support material affixed thereacross. The exterior ring is adapted to be supported by, and preferably releasably attached to, the inwardly extending flange of the peripheral frame portion.

The container is constructed such that the first and second pairs of opposed walls include a plurality of relatively large apertures which represent a substantial portion of the walls. At least one of first and second pairs of opposed walls also includes attachment members for securing the inner receptacle to the opposed walls. In addition, at least one of the first and second pairs of opposed walls preferably includes an integral handle formed therein. Still further, one of the first and second pairs of opposed walls can include bail arms pivotably attached thereto.

In accordance with the present invention, a collapsible container is provided which is adapted to receive an inner receptacle. The collapsible container includes a base for supporting a lower portion of the inner receptacle, wherein the base has a peripheral frame portion defining at least one relatively large opening therebetween. The collapsible container further includes a first pair of opposed walls pivotably attached to the peripheral frame portion and movable between an assembled position and a collapsed position, and a second pair of opposed walls pivotably attached to the peripheral frame portion and movable between an assembled position and a collapsed position. Each of the second pair of opposed walls is also releasably attached to an adjacent one of the first pair of opposed walls in the assembled position. Orienting the first and second pairs of opposed walls in the assembled position thereby defines a compartment area for receiving the inner receptacle.

According to the present invention, one of the first and second pairs of opposed walls includes a guide projection and the other includes a guide receiver for aligning the first and second pairs of opposed walls in the assembled position. In addition, one of the first and second pairs of opposed walls of the collapsible container preferably includes a latch and the other includes a latch receiver for securing the first and second pairs of opposed walls in the assembled position. More particularly, the latch receiver is disposed within a flange which depending inwardly from each of the first pair of opposed walls, wherein the latch receiver includes a latch aperture and a user actuable release portion. The aperture is sized for slidingly receiving the corresponding latch. When the container is oriented in the assembled position, a user can release the container from the assembled position by actuating the user actuable release portion to release the latch from the latch aperture.

The peripheral frame portion of the collapsible container includes an inwardly extending flange for supporting the lower portion of the inner receptacle. A base member can be provided to extend across the relatively large opening of the peripheral frame portion, where the base member can include at least one cross- member attached to the peripheral frame portion or, alternatively, an exterior ring and a light-weight support material affixed thereacross. In the latter embodiment, the exterior ring is adapted to be supported by the inwardly extending flange of the peripheral frame portion. At least one of the first and second pairs of opposed walls of the collapsible container of the present invention preferably includes attachment members for securing the inner receptacle to the opposed walls.

In further accordance with the present invention, a container assembly is provided. The container assembly includes a base having a peripheral frame portion which defines at least one relatively large opening therebetween. A first pair of opposed walls extends upwardly from the peripheral frame portion, and a second pair of opposed walls extends upwardly from the peripheral frame portion and is attached to the first pair of opposed walls. As assembled, the first and second pairs of opposed walls and the base define a compartment area. The container assembly further includes an inner receptacle received within the compartment area, where a lower portion of the inner receptacle is supported by the peripheral frame portion.

In a preferred embodiment of the present invention, the inner receptacle is disposable, and may also be flexible. The inner receptacle can include a box or a bag, and may include a plurality of ventilation apertures.

As with other embodiments according to the present invention, the peripheral frame portion of the container assembly includes an inwardly extending flange for supporting the lower portion of the inner receptacle. The container assembly can also include a base member extending across the relatively large opening of the peripheral frame portion.

Still further, the first and second pairs of opposed walls include a plurality of relatively large apertures which represent a substantial portion of the walls. At least one of the first and second pairs of opposed walls also includes attachment members for securing the inner receptacle to the opposed walls, where the attachment members can be used to suspend the inner receptacle within the compartment area. Furthermore, at least one of the first and second pairs of opposed walls preferably includes an integral handle.

Lastly, the first and second pairs of opposed walls can each be pivotably attached to the peripheral frame portion and releasably attached to each other, such that the first and second pairs of opposed walls are orientable between an assembled position and a collapsed position. More specifically, one of the first and second pairs of opposed walls includes a latch and the other includes a latch receiver for securing the first and second pairs of opposed walls in the assembled position.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
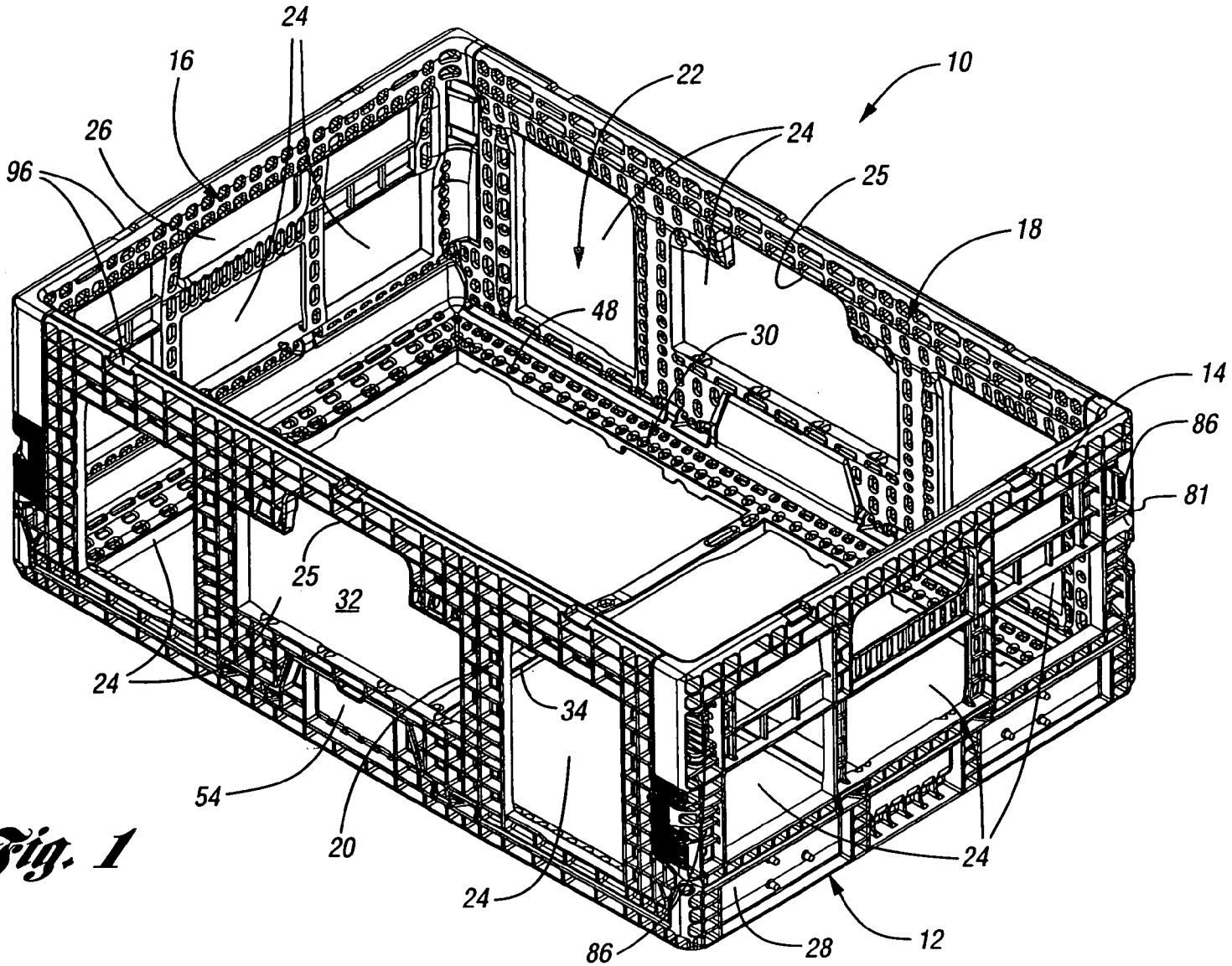
FIG. 1 of the drawings illustrates a top perspective view of a first embodiment of a container according to the present invention oriented in an assembled position.

Referring first to FIGS. 1–14, a first embodiment of a container according to the present invention is illustrated and indicated generally by reference numeral 10. Container 10 is adapted to receive an inner receptacle as described herein. Unlike prior art containers, container 10 of the present invention includes the only the minimum structure and material necessary to construct the container framework. In effect, the inner receptacle received within container 10 provides the remaining base and wall structure. Container 10 provides the top load strength and protection necessary during shipping and handling, while dirt and other foreign matter is removed and disposed of with the inner receptacle.

As shown in FIGS. 1–9, container 10 includes a base 12 for supporting a lower portion of the inner receptacle. A first pair of opposed walls 14, 16 extends upwardly from base 12, and a second pair of opposed walls 18, 20 extends upwardly from base 12 and is attached to the first pair of opposed walls 14, 16. For convenience, and without additional limitation, first pair of opposed walls 14, 16 will be referred to herein as end walls, and second pair of opposed walls 18, 20 will be referred to herein as side walls. As assembled, end walls 14, 16, side walls 18, 20, and base 12 define a compartment area 22 for receiving the inner receptacle therein. Although a rectangular container 10 is shown and described herein, the present invention is not limited thereto and may include end walls 14, 16 and side walls 18, 20 of equal length forming a container having square dimensions, or any other shape feasible according to the desired size and use. Furthermore, although side walls 18, 20 and end walls 14, 16 are depicted herein to be substantially flat, side walls 18, 20 and end walls 14, 16 could alternatively be bowed outward, away from compartment area 22, and have an arcuate shape. A bowed configuration generally serves to increase the interior volume of container 10, thereby allowing containers 10 to store and transport more product.

The components of container 10 are formed or substantially formed of various types of plastic or polymeric materials (preferably thermoplastic), typically by an injection molding or other plastic molding process. Of course, components of container 10 can be constructed using any other material suitable to this application. As is well understood in the art, the thickness of each of the components of container 10 illustrated and disclosed herein may vary depending on the intended usage and other characteristics desired from container 10.

While container 10 is suited for many uses, container 10 is particularly suitable for storing and transporting produce such as fruits and vegetables. With reference to FIGS. 1–4 and 8–9, container 10 is constructed such that end walls 14, 16 and side walls 18, 20 each include a plurality of relatively large apertures 24 which represent a substantial portion of the walls 14, 16, 18, 20. Apertures 24 allow for less material and thus keep container 10 lightweight and also foster circulation for the produce stored within container 10. In addition, apertures 24 allow greater visibility of the goods transported and stored within container 10. It is understood, of course, that apertures 24 can have any shape and overall layout within side walls 18, 20 and end walls 14, 16. End walls 14, 16 can also include integral handles 26 to facilitate carrying container 10. Another type of hand opening 25 is also be provided on side walls 18, 20 such that a gripping structure is provided on each wall 14, 16, 18, 20 of container 10.

Figure 2:
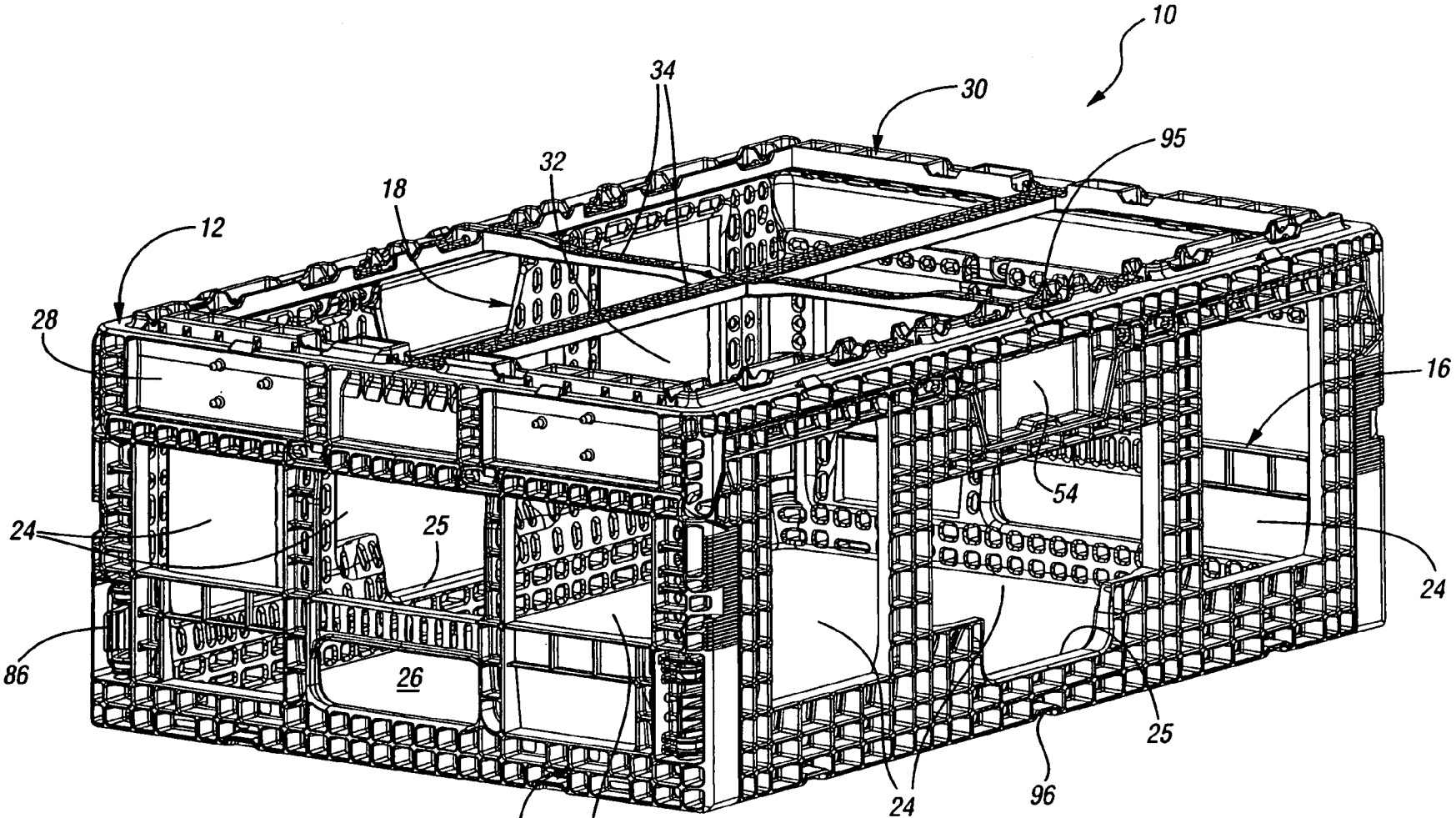
FIG. 2 is a bottom perspective view of the container of FIG. 1 oriented in the assembled state.
Figure 3:
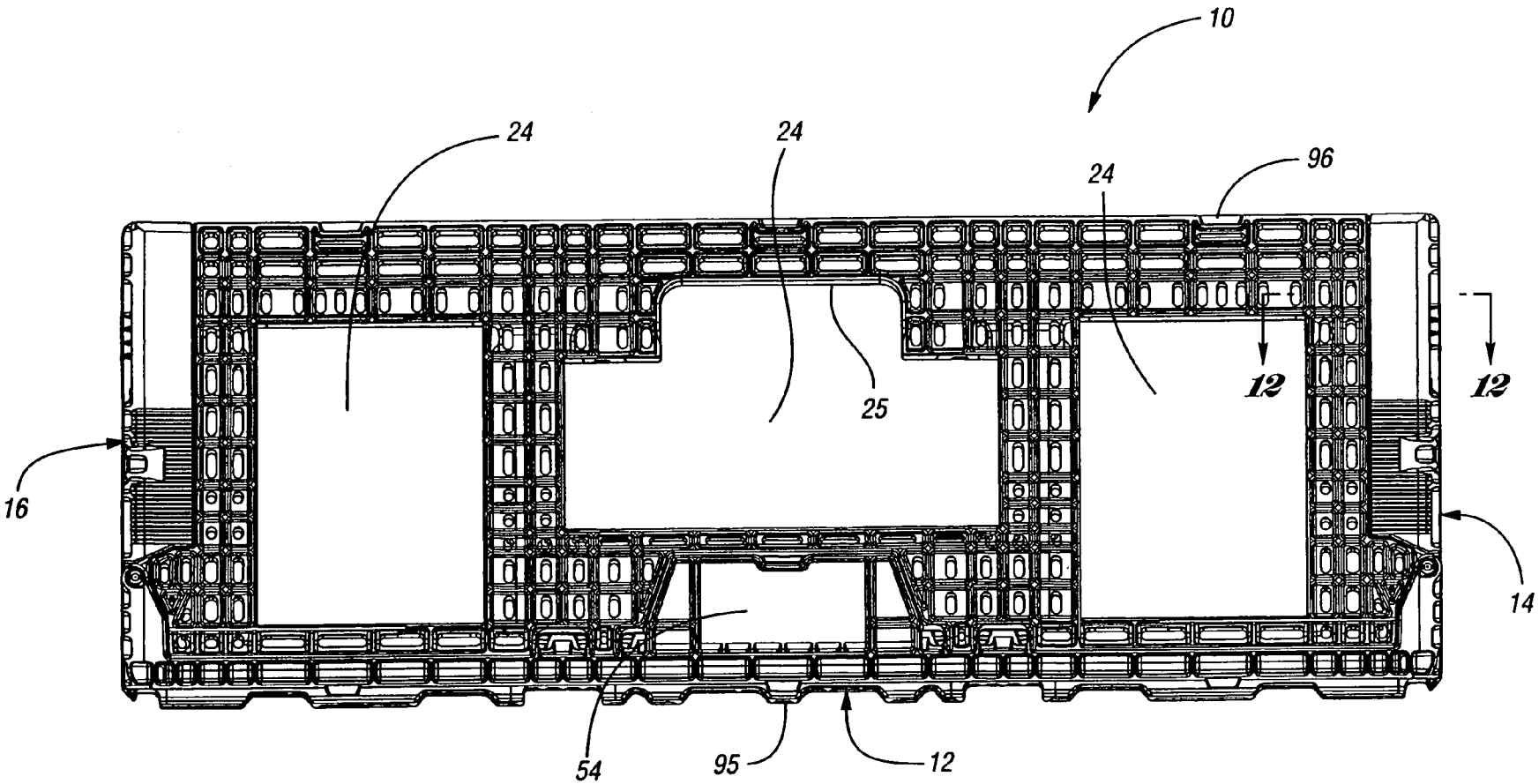
FIG. 3 is a front side elevational view of the container of FIG. 1, the rear side being a mirror image thereof.
Figure 4:
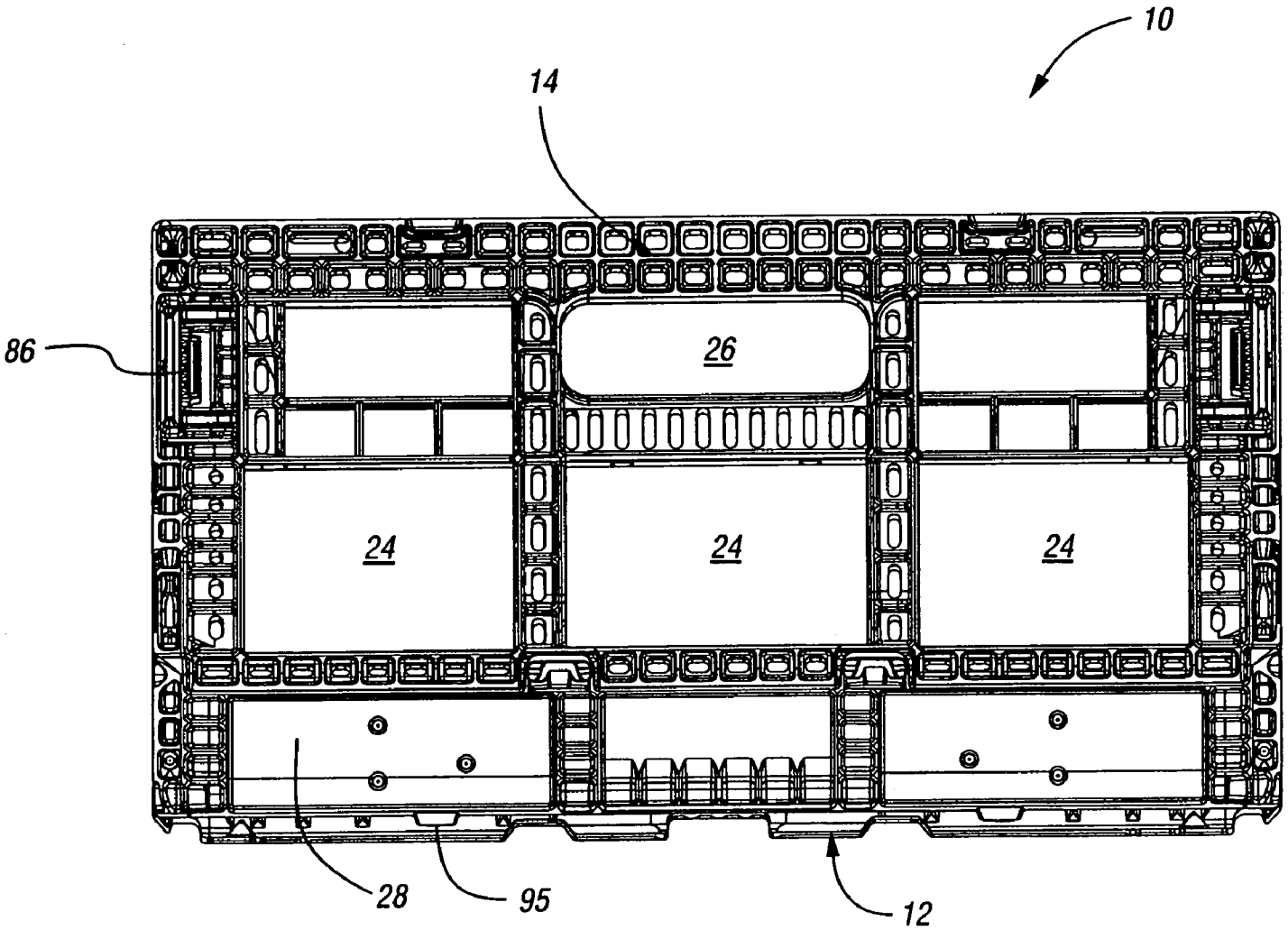
FIG. 4 is a left side elevational view of the container of FIG. 1, the right side being a mirror image thereof.

As best shown in FIGS. 1, 2, and 4, at least one of side walls 18, 20 and end walls 14, 16 (particularly shown on end wall 14) also includes a substantially flat area 28 that is devoid of apertures and which can be used for identification purposes. Such identification can include a removable label, an attached bar code, or a radio frequency identification (RFID) transmitter for tracking the contents of container 10.

Figure 5:
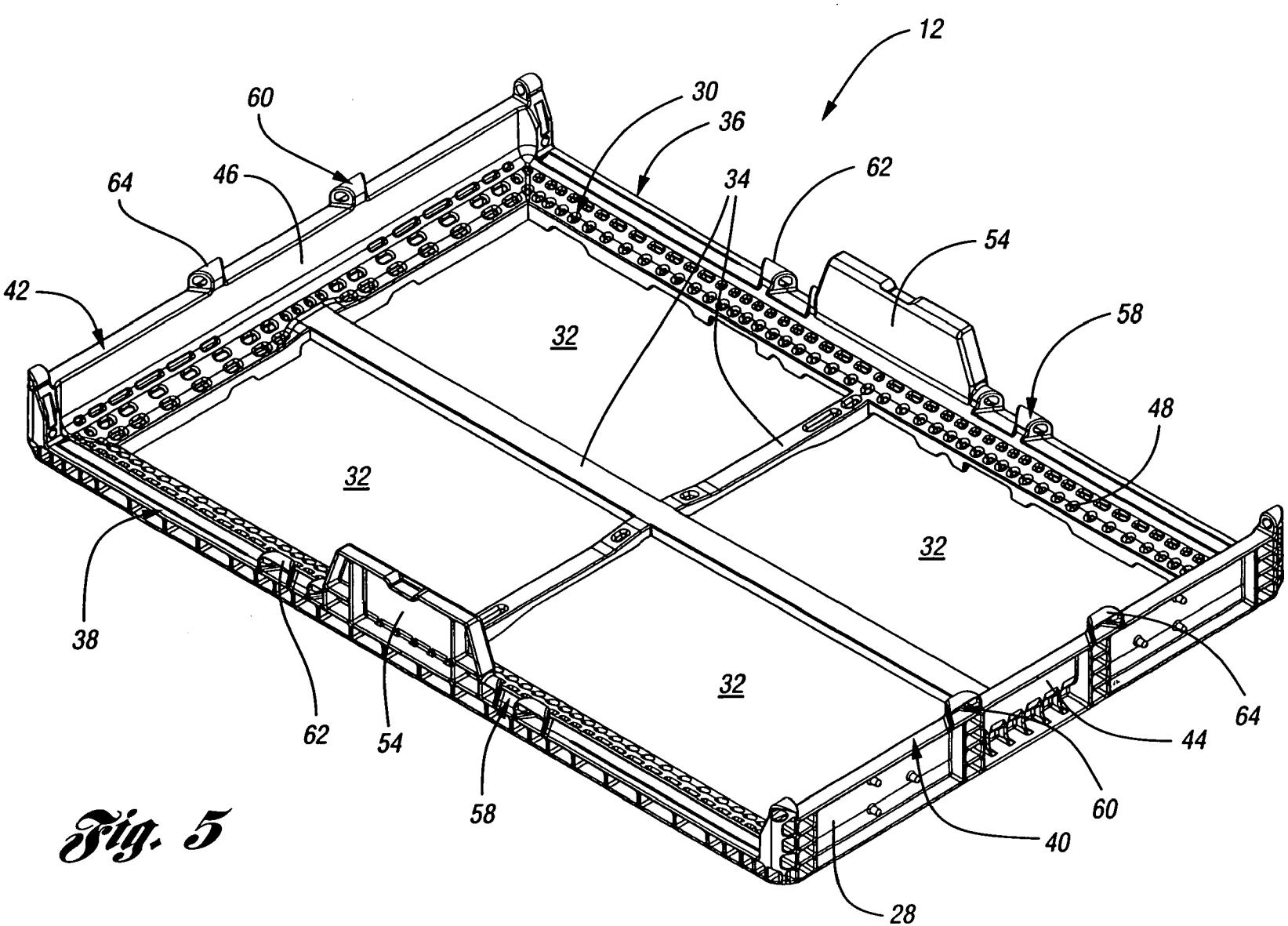
FIG. 5 illustrates a perspective view of the base of the container of FIG. 1.
Figure 6:
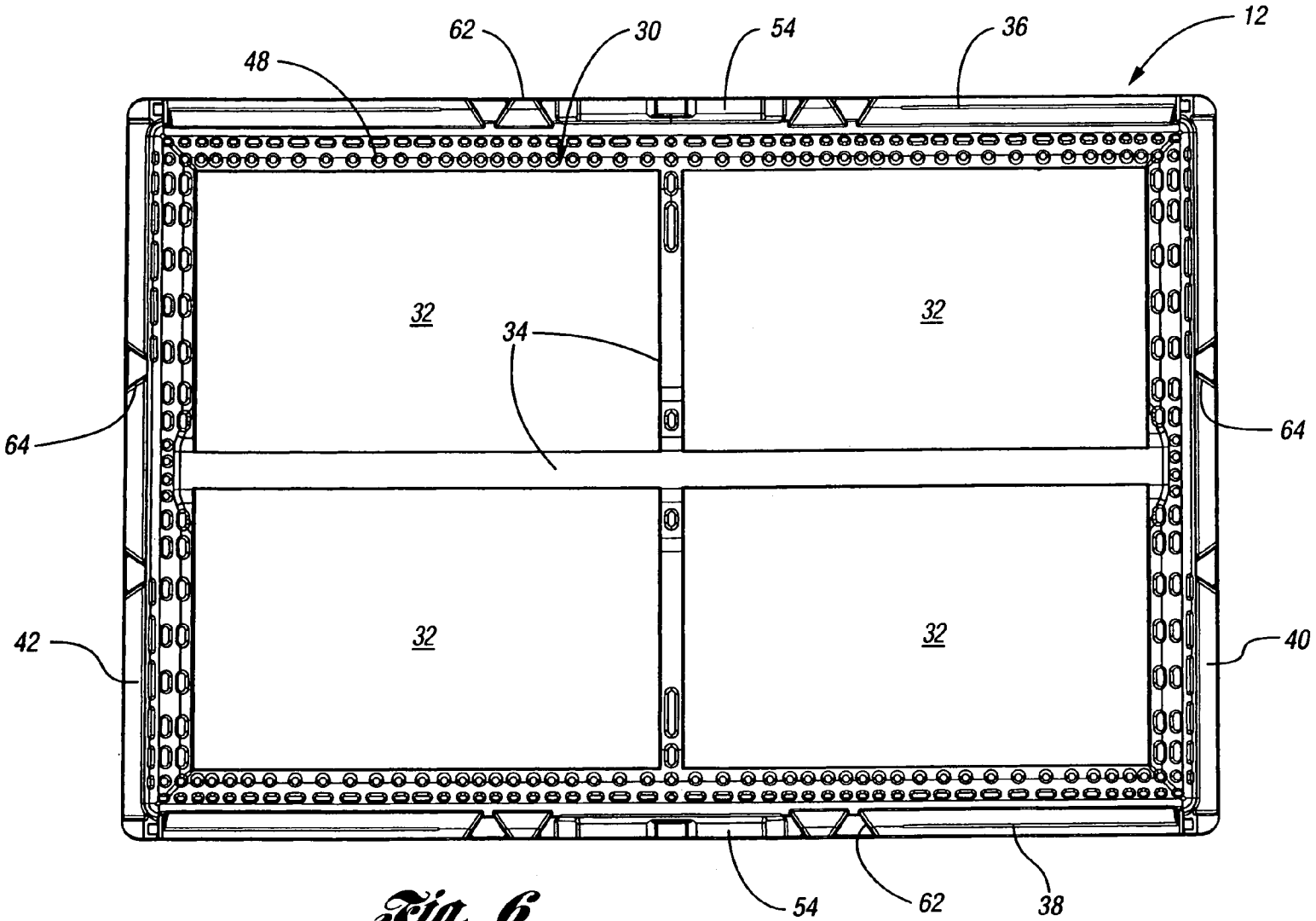
FIG. 6 is a top plan view of the base of FIG. 5.
Figure 7:
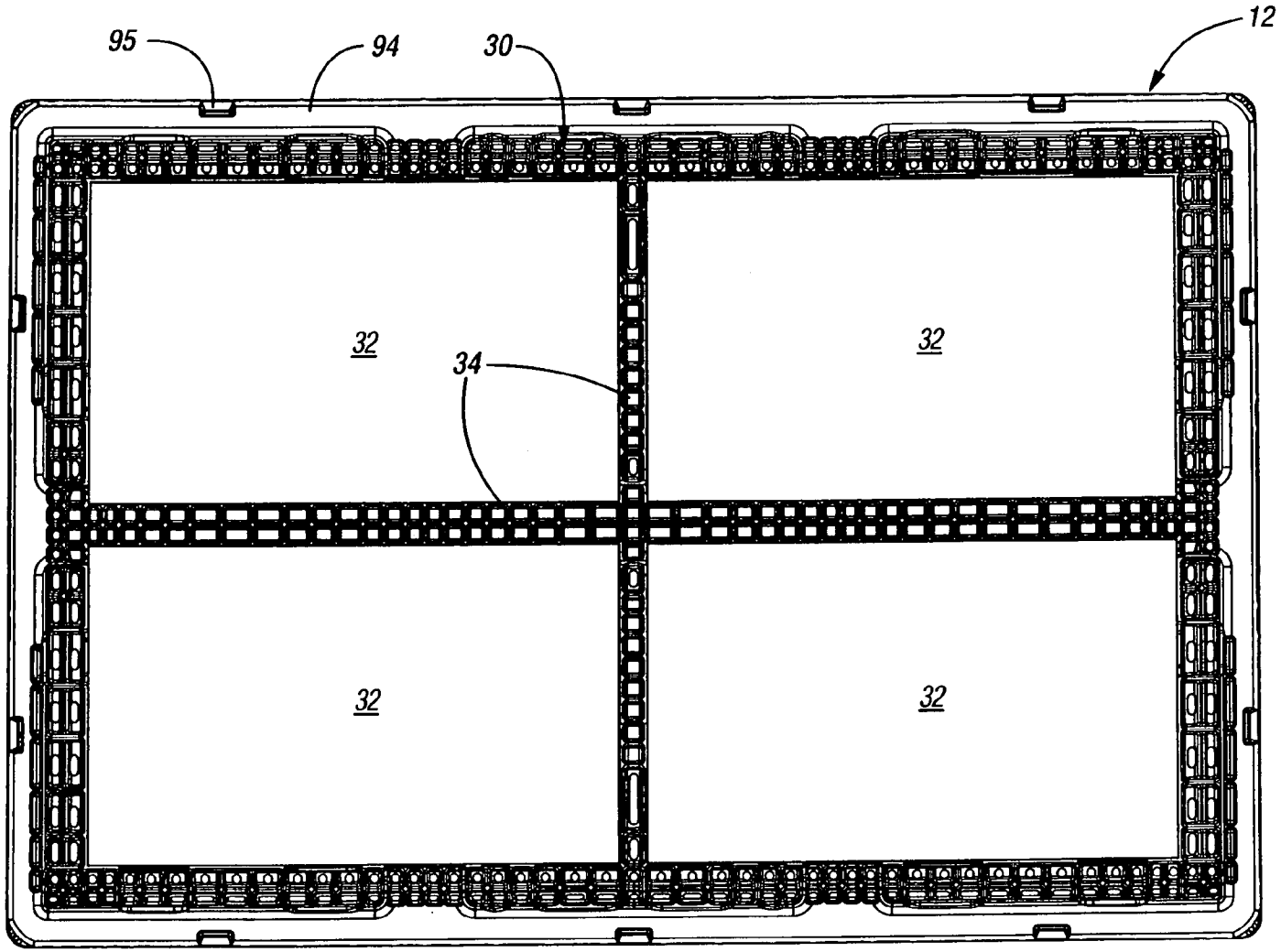
FIG. 7 is a bottom plan view of the base of FIG. 5.

Base 12 is best illustrated in the bottom perspective view of FIG. 2, the base perspective view of FIG. 5, and the top and bottom base plan views of FIGS. 6 and 7, respectively. Base 12 includes a peripheral frame portion 30 which defines at least one relatively large opening 32 therebetween. Still further, base 12 can include a base member extending across peripheral frame portion 30. In the embodiment shown, the base member is shown as cross members 34 which are attached to peripheral frame portion 30 to define four openings 32 therebetween. Cross members 34 add structural rigidity to container 10 and provide additional support for the inner receptacle. Peripheral frame portion 30 includes a pair of opposed side edge members 36, 38, and a pair of opposed end edge members 40, 42. As shown, end edge members 40, 42 are preferably formed on integrally molded upstanding base walls 44, 46. Peripheral frame portion 30 further includes an inwardly extending flange 48 for supporting the lower portion of the inner receptacle. Flange 48 preferably extends inward a sufficient distance to support the inner receptacle thereon without requiring the use additional supports. The substantially open structure of base 12 further reduces the weight of container 10 and prevents the use of container 10 for other than its intended purpose.

Figure 14:
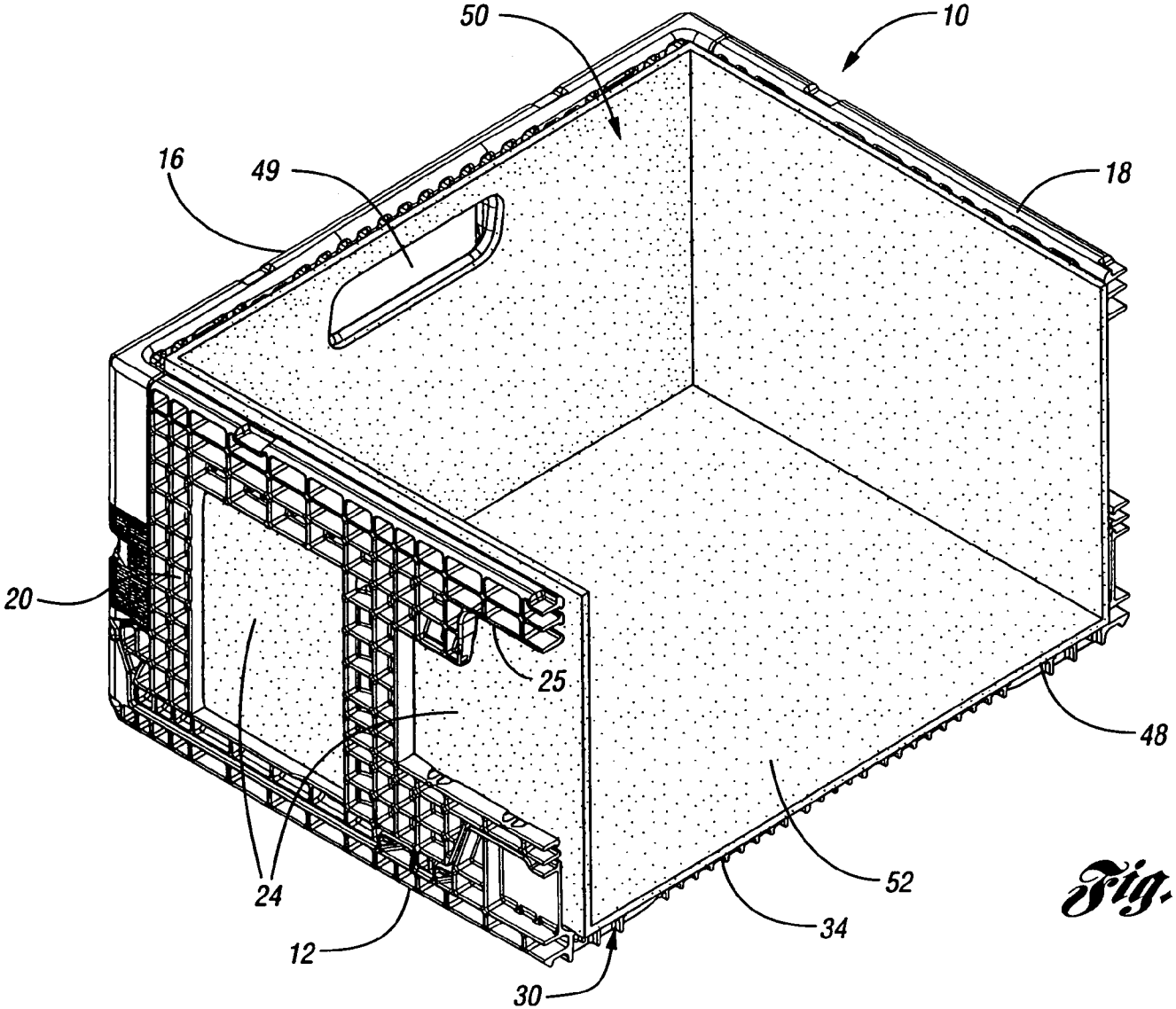
FIG. 14 is a partial perspective view of the container shown in the assembled state of FIG. 1, wherein the container is shown in assembly with an inner receptacle, and more particularly a box.
Figure 15:
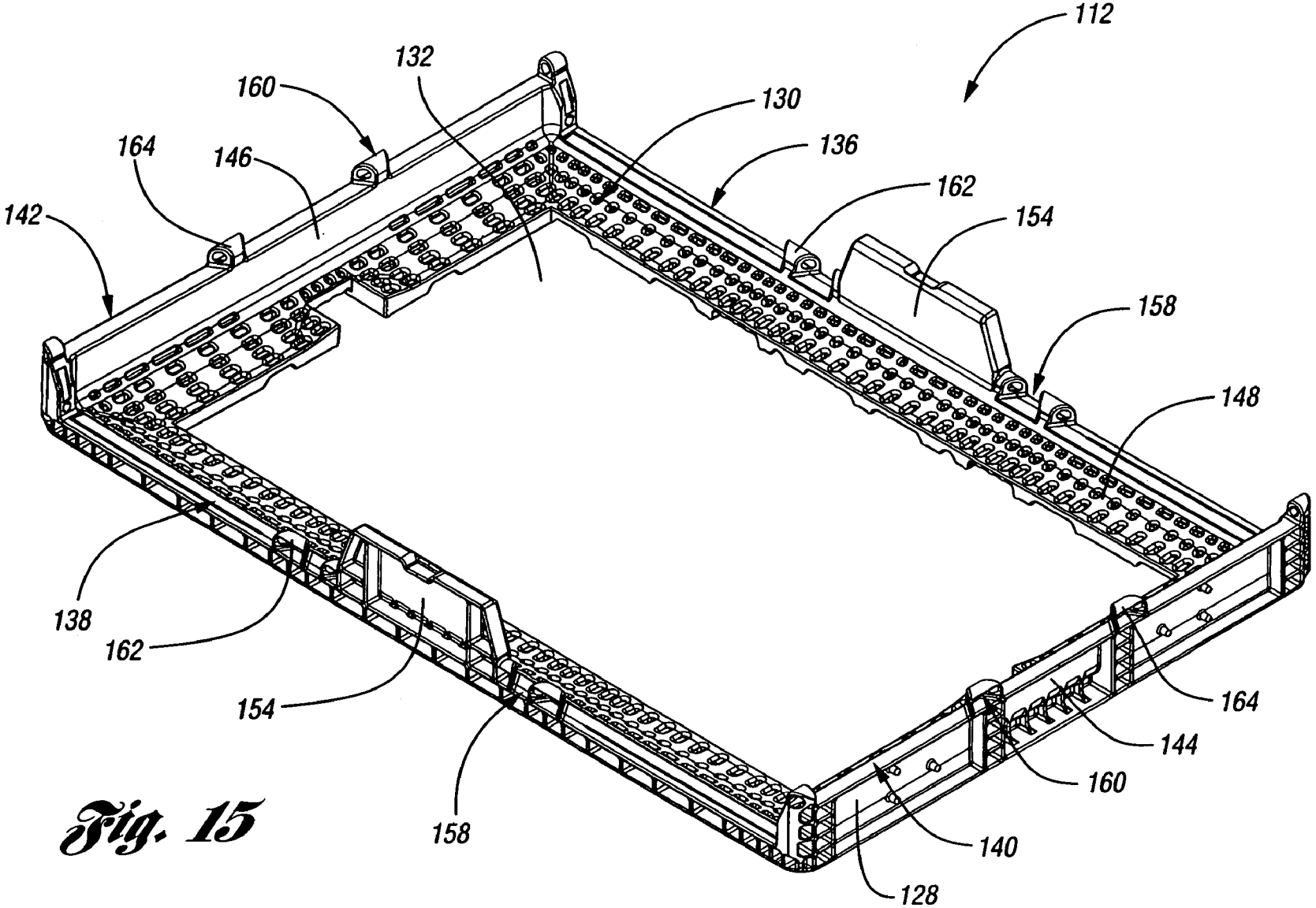
FIG. 15 illustrates a perspective view of a second embodiment of the base in accordance with the present invention.
Figure 16:
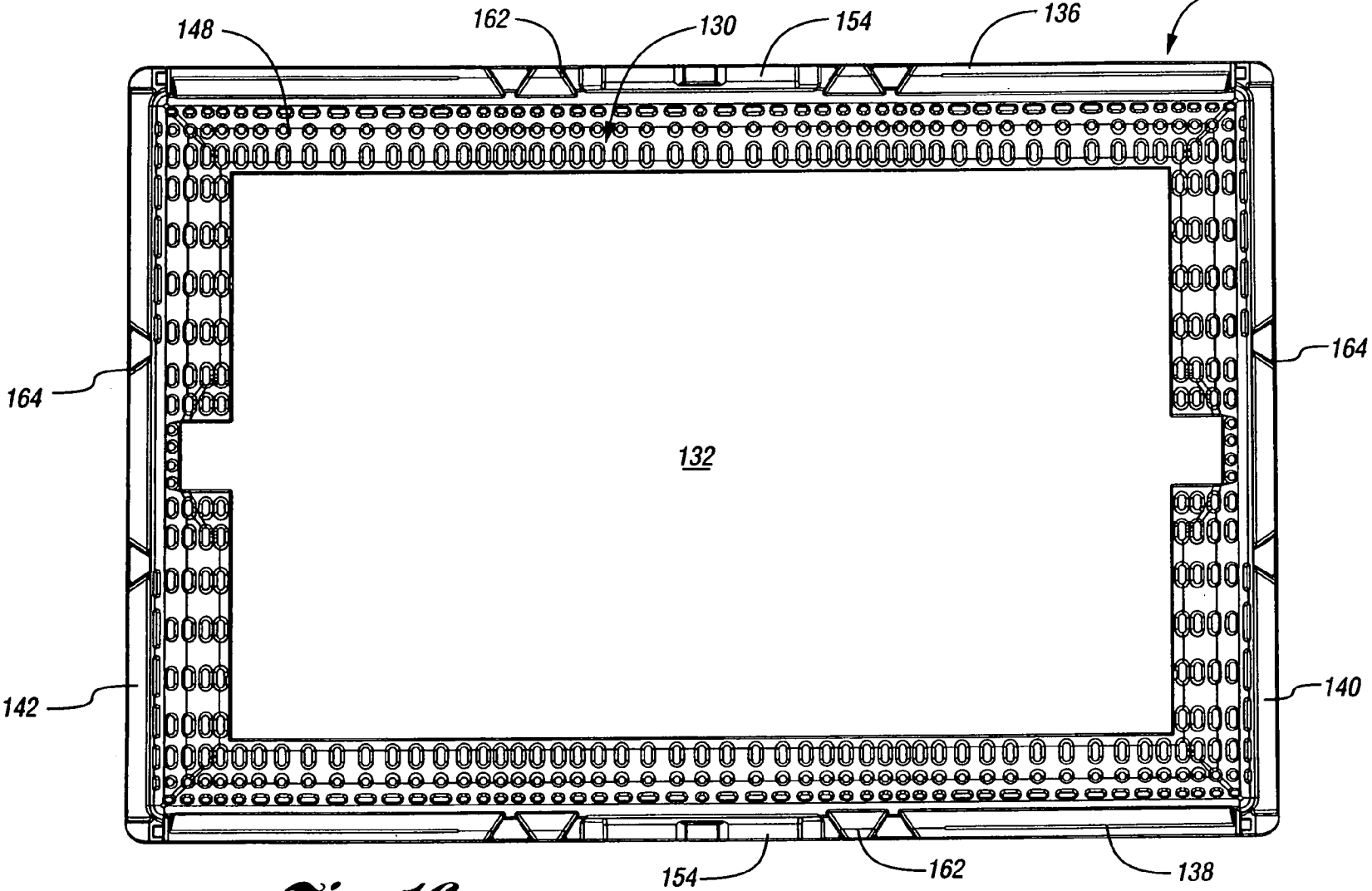
FIG. 16 is a top plan view of the base of FIG. 15.
Figure 17:
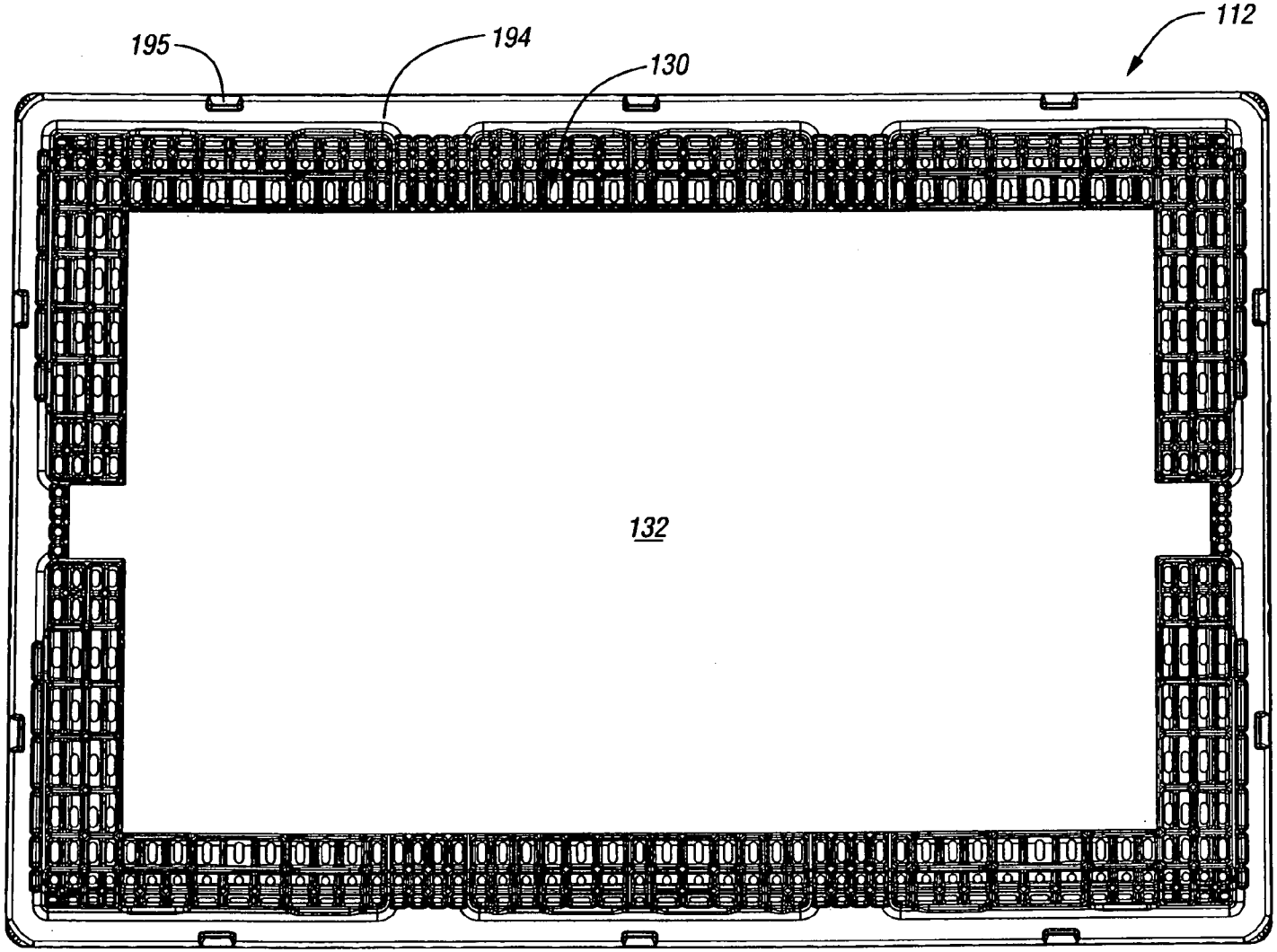
FIG. 17 is a bottom plan view of the base of FIG. 15.

Container 10 is shown in assembly with an inner receptacle in the partial perspective view of FIG. 14. Specifically, the inner receptacle of FIG. 14 is a box 50 constructed from a material such as cardboard is received within compartment area 22, wherein a lower portion 52 of box 50 is supported by base 12, and more particularly by peripheral frame portion 30. Box 50 is preferably provided with hand openings 49 aligned with handles 26 on end walls 14, 16 to aid in carrying the container assembly. Box 50 can also be provided with a plurality of ventilation apertures (see, for example, the inner receptacle embodiment depicted in FIGS. 21–24), wherein flexibility in ventilation is afforded. More specifically, since different types of produce have different ventilation requirements, the number and size of ventilation apertures provided in the inner receptacle can be custom designed for the specific application. Light exposure can be controlled in a similar manner.

Due to apertures 24 provided in side walls 18, 20 and end walls 14, 16, the inner receptacle (such as box 50 of FIG. 14) is largely visible therethrough. Therefore, the inner receptacle can be custom-colored and provided with graphics which indicate the type and brand of produce commodity being transported therein. Once the container 10 reaches the retailer, the inner receptacle can be removed from container 10 and used to display the produce.

Figure 9:
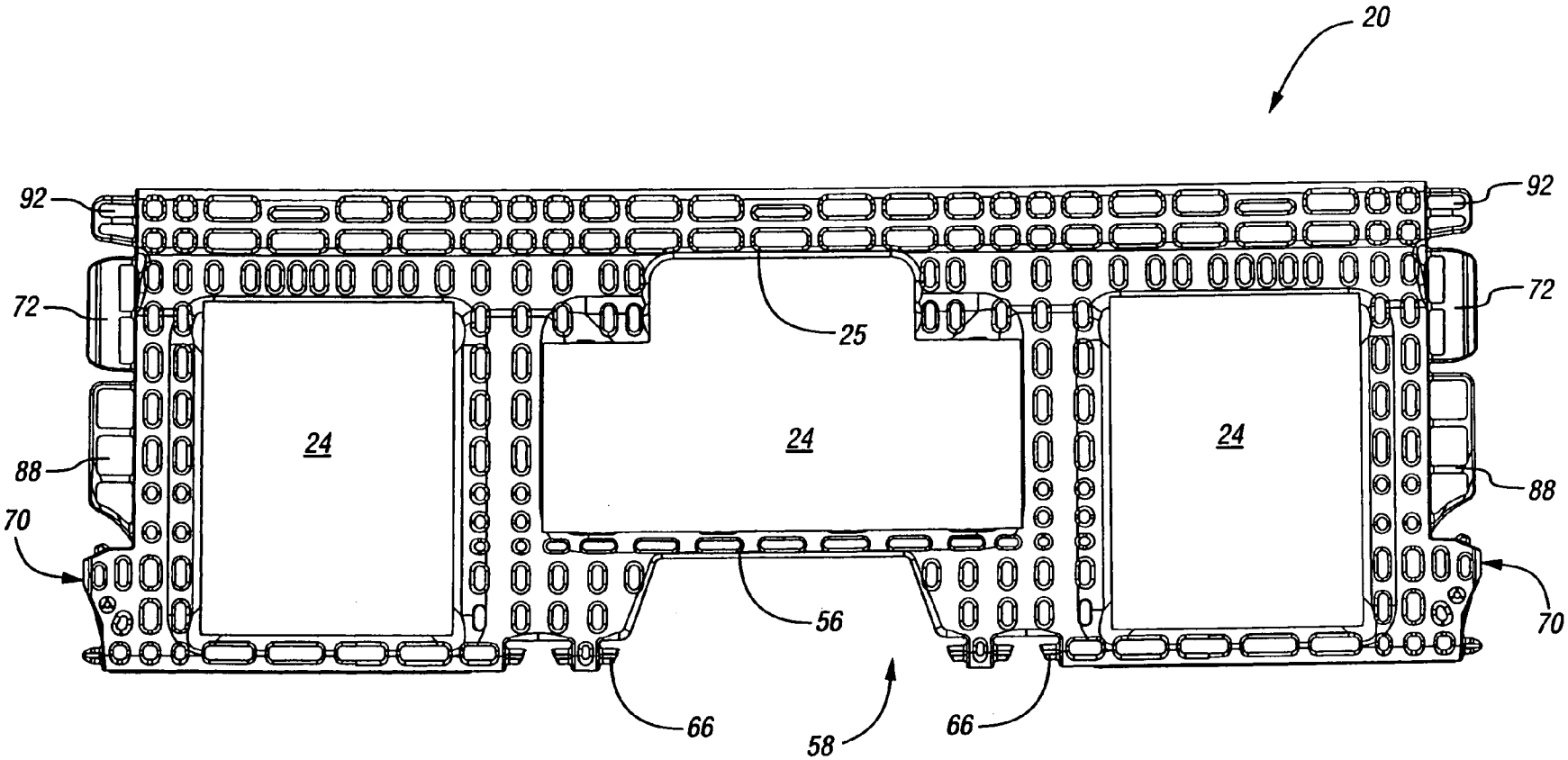
FIG. 9 is an elevational view of a side wall of the container of FIG. 1.

As further illustrated in FIGS. 1, 2, and 5, base 12 also includes a pair of opposed upstanding members 54 which are integrally formed with base 12 along side edges 36, 38. While members 54 are shown having a substantially trapezoidal shape, it is contemplated that any number of shapes may be applicable and feasible according to the present invention. Preferably, upstanding members 54 are centrally located along the length of side edges 36, 38. As best shown in FIG. 9, side walls 18, 20 have a lower recessed edge portion 56 for receiving and mating with the corresponding member 54 when container 10 is in the assembled orientation of FIGS. 1 and 2. Members 54 provide additional structural and torsional stability to container 10 when assembled. Members 54 also provide structural stability to one or more containers 10 which are stacked together when in the inwardly folded position shown in FIG. 11. In this orientation, members of a lower container receive at least a portion of the top load from an upper container, thereby allowing the top load from the upper container to be transferred directly to base 12 through members 54. Still further, members 54 provide an additional area for labels or other identification of container 10.

In the embodiment of container 10 depicted in FIGS. 1–14, container 10 is constructed to be collapsible. Collapsible containers are advantageous in that they can be folded or otherwise reduced in size when not in use, thereby providing a compact size when storage space is minimal. An alternative collapsible embodiment of container 10 is shown in FIGS. 15–20, and a non-collapsible embodiment is described below with reference to FIGS. 21–24.

Figure 8:
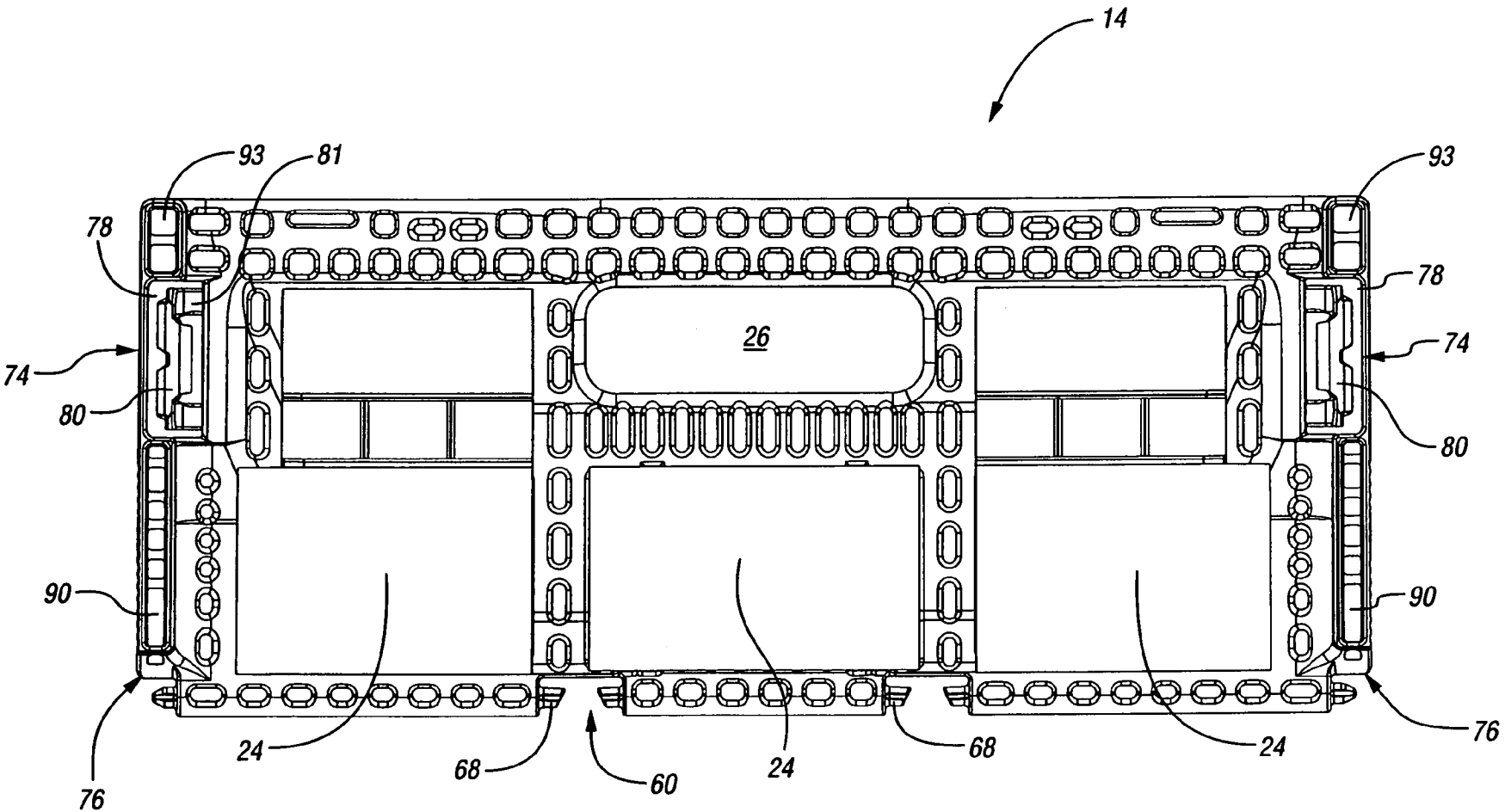
FIG. 8 is an elevational view of an end wall of the container of FIG. 1.

In the collapsible container embodiment illustrated in FIGS. 1–14, side walls 18, 20 are pivotably attached to side edges 36, 38 of peripheral frame portion 30 by way of a hinging system 58 (best shown in FIGS. 5, 8, and 9). Hinging system 58 allows side walls 18, 20 to be foldably positioned in three orientations: the assembled container orientation illustrated in FIGS. 1 and 2, the outwardly collapsed position illustrated in FIG. 10, and the inwardly collapsed position illustrated in FIG. 11. As used herein, the terms inwardly and outwardly designate a general direction of movement of the various walls 14, 16, 18, 20 toward base 12 and away from base 12, respectively.

Likewise, end walls 14, 16 are similarly pivotably attached to end edges 40, 42 of peripheral base portion 30 by way of a hinging system 60 which is similar in structure to hinging system 58. More particularly, end walls 14, 16 are pivotably attached to upstanding base walls 44, 46, respectively, of base 12, at a distance remote from peripheral frame portion 30. As with side walls 18, 20, end walls 14, 16 are orientable in three positions: assembled as shown as in FIGS. 1–2, outwardly collapsed as in FIG. 10, and inwardly collapsed as in FIG. 11. Hinging systems 58 and 60 include a plurality of lower hinge portions 62 and 64, respectively, integrally formed with base 12 to mate with and attach to upper hinge members 66 and 68, respectively, included on the corresponding walls (see FIGS. 5, 8, and 9). Of course, this type of hinge is shown by way of example and not limitation, as the hinge system utilized may be any type known or contemplated which is feasible for this use. Furthermore, it is contemplated that container 10 need not be positionable in both the inwardly and outwardly collapsed positions, but may be designed such that it is orientable in one or the other.

Figure 10:
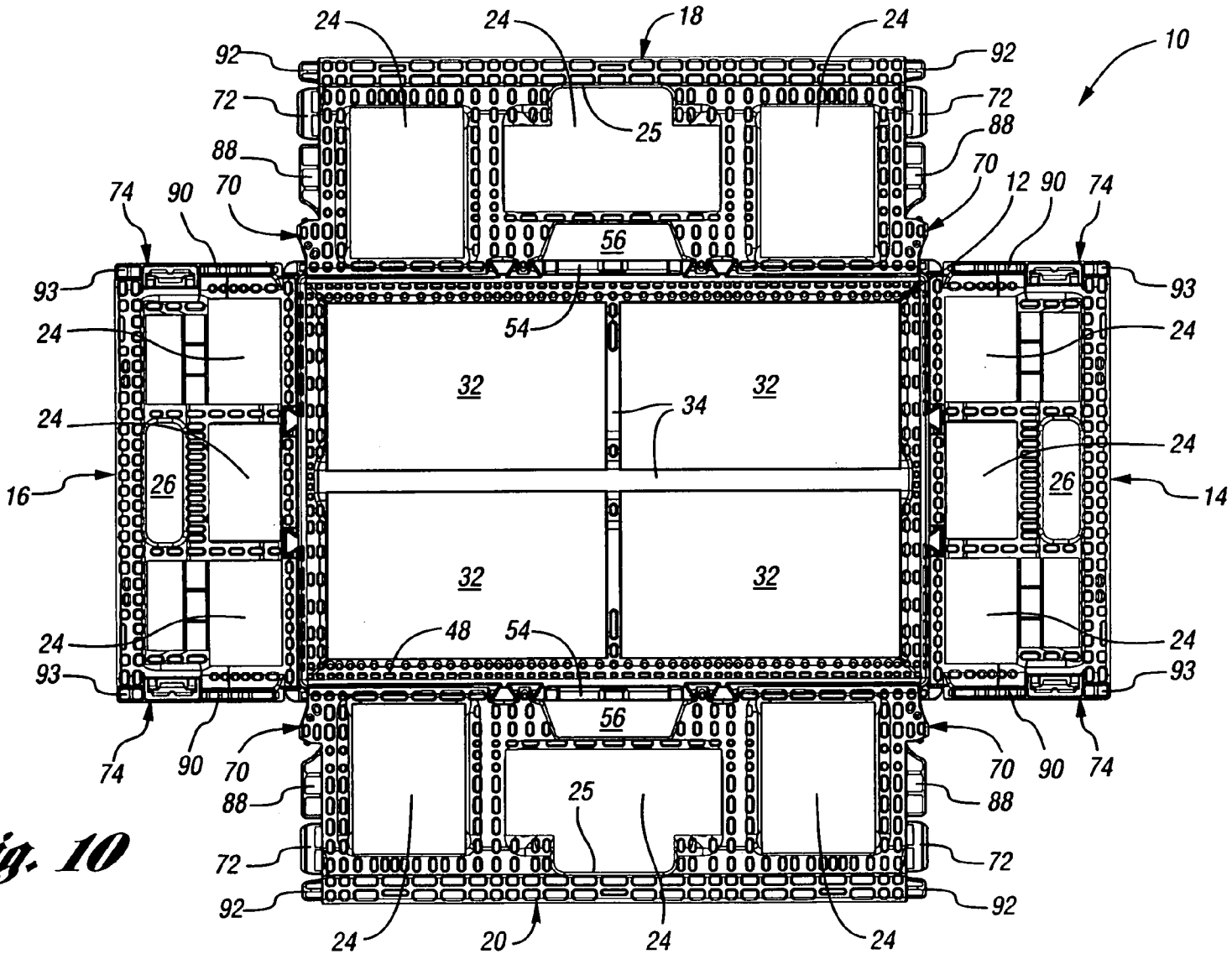
FIG. 10 illustrates the container of FIG. 1 with the side and end walls in an outwardly folded orientation.

Each of side walls 18, 20 is also releasably attached to an adjacent one of end walls 14, 16 in the assembled position of FIGS. 1 and 2. Accordingly, further included in container 10 is a locking or latching system for latching side walls 18, 20 together with end walls 14, 16 to achieve the desired stability of assembled container 10. With reference to FIGS. 8–10, provided on the lateral edges 70 of side walls 18, 20 is a latch member 72 extending outwardly therefrom. Correspondingly, end walls 14, 16 each include inwardly depending flanges 76, wherein each flange 76 includes a latch receiving system 74 for receiving latch member 72 and securing side walls 18, 20 and end walls 14, 16 in the assembled position. More particularly, latch receiving system 74 includes a latch receiving aperture 78 which is appropriately sized and shaped to slidingly receive latch member 72. A receiver member 80 is disposed adjacent to aperture 78 and is attached to end wall 14, 16 by a spring member or living hinge 81. Receiver member 80 is thus flexible over its length, and particularly actuable in the side to side direction.

Figure 11:
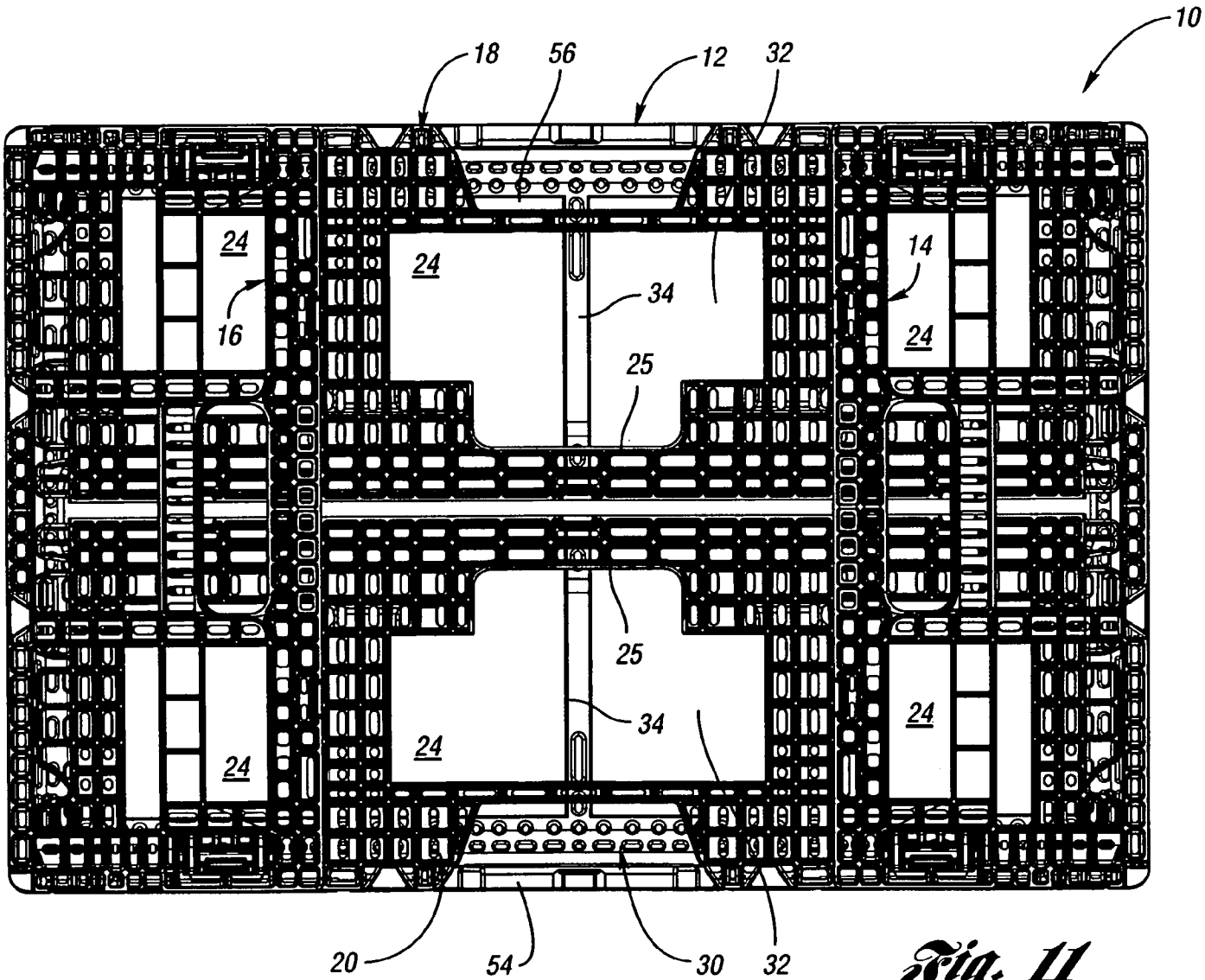
FIG. 11 illustrates the container of FIG. 1 with the side and end walls in an inwardly folded orientation, wherein the opposed side walls are first folded inwardly and then the opposed end walls are folded inwardly.
Figure 12:
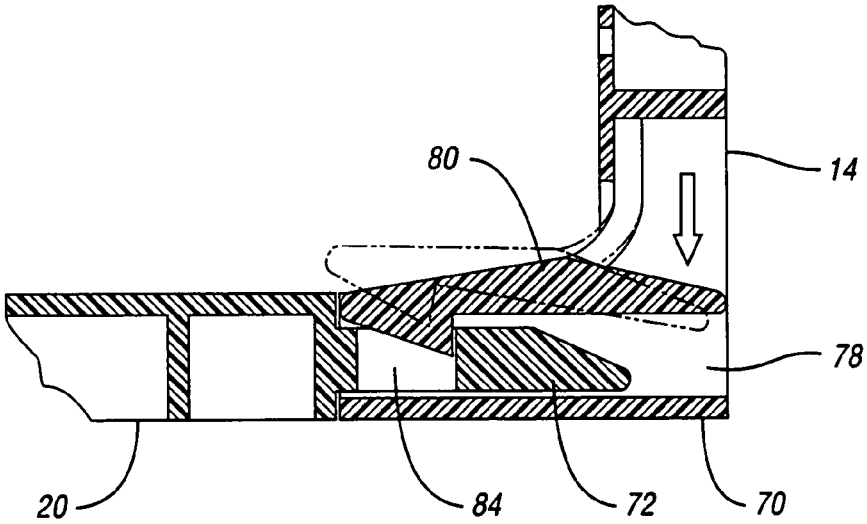
FIG. 12 is a top plan sectional view taken along line 12—12 of FIG. 3 of the assembled latching system for latching together the side walls and end walls.
Figure 13:
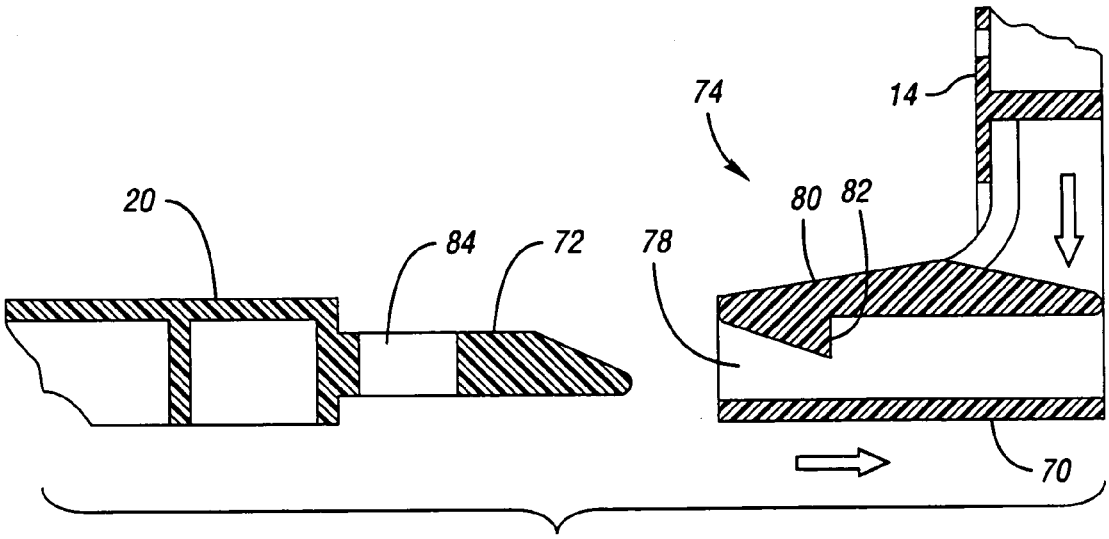
FIG. 13 is a top plan sectional view of the latching system of FIG. 12 in a disassembled orientation with the side wall shown separated from the end wall.

As further illustrated in the top plan sectional views of FIGS. 12–13, a projection member 82 is disposed on receiver member 80 for being received by a corresponding aperture 84 formed in latch member 72. During the assembled state, projection member 82 retains latch member 72 in a secure manner and provides the stability desired for maintaining container 10 in the assembled position. With further reference to FIGS. 12 and 13, in order to collapse container 10 from the assembled orientation into the folded orientations of FIGS. 10 and 11, an outer release member 86 (accessible from the outside of container 10) of receiver member 80 is actuated and moved laterally by the user (its movement shown in phantom in FIG. 12), and projection 82 is accordingly raised from aperture 84 in latch member 72, allowing latch member 72 to be released from latch receiving system 74. Release member 86 is best illustrated in FIGS. 1, 2, and 4.

Again referring to FIGS. 8–10, lateral edges 70 of side walls 18, 20, may also include a guide projection such as first tab member 88 which projects from a lower portion thereof for alignment purposes. In an assembled container 10, first tab member 88 is received by a corresponding guide receiver such as opening 90 which resembles a narrow slot on flanges 76 of end walls 14, 16. Opening 90 securely receives first tab member 88 in order to align and orient the adjoining walls, as well as secondarily assisting in securely holding side walls 18, 20 and end walls 14, 16 upright together when assembled. Moreover, an upper portion of lateral edges 70 may also include a second tab member 92 which is relatively smaller than first tab member 88. Like first tab member 88, second tab member 92 is received during assembly by a corresponding tab opening 93 formed in flanges 76 of end walls 14, 16. Second tab member 92 is provided generally for alignment purposes as well as to provide an additional point of engagement between the adjoining walls 14, 16, 18, 20.

Figure 25:
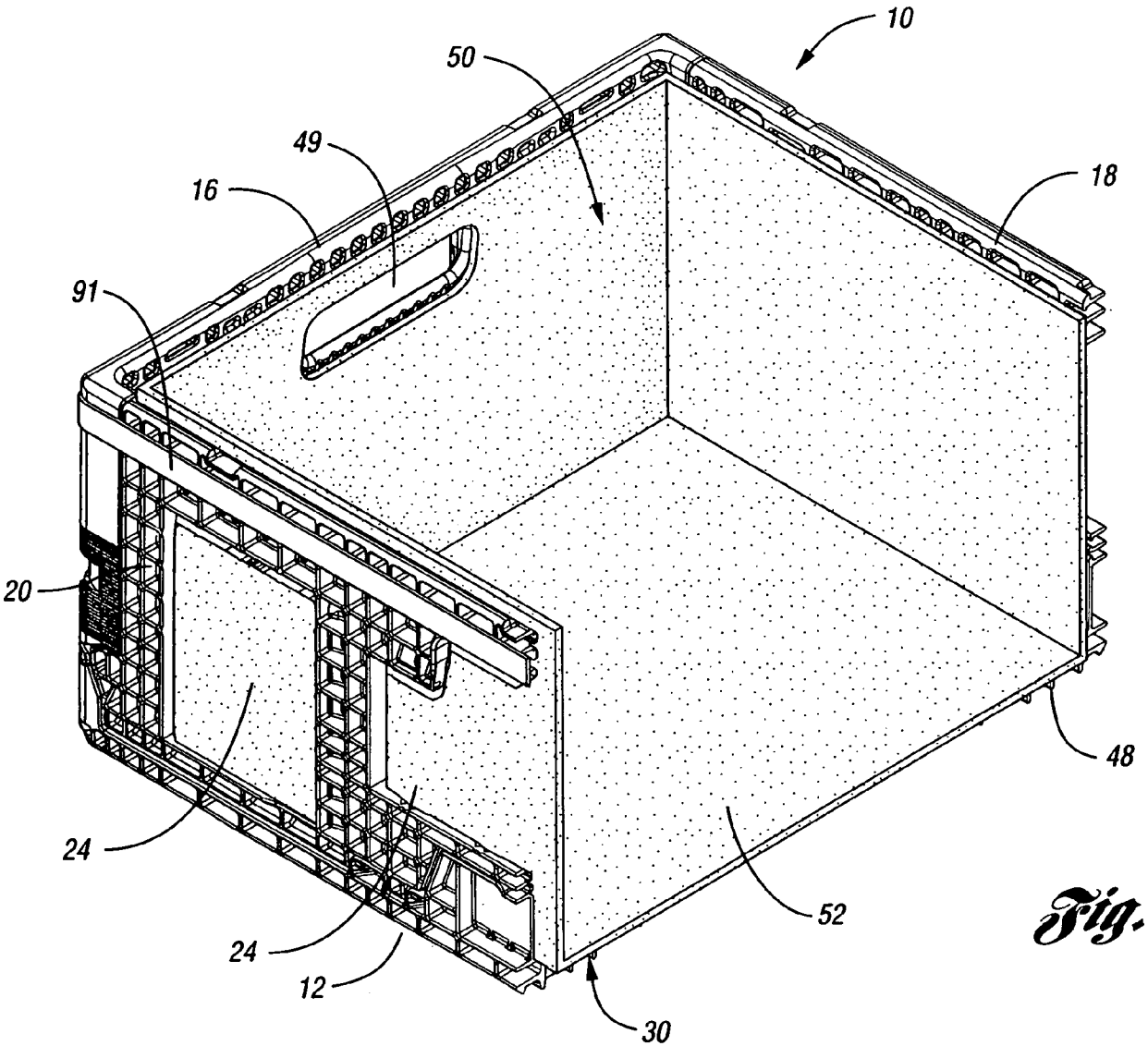
FIG. 25 is a partial perspective view of the container assembly of FIG. 14, wherein the container is secured in the assembled state with a strap.

It is also contemplated that first tab member 88, second tab member 92, or like structures could be provided without the latching system described previously. With this configuration, end walls 14, 16 and side walls 18, 20 are aligned in the assembled position by tab members 88, 92, and are secured together by other means. For example, as shown in FIG. 25, an elastic band or adjustable strap 91 could be fitted around the exterior of container 10 to hold walls 14, 16, 18, 20 in the assembled position.

Referring now to FIG. 10, container 10 is illustrated in an outwardly folded configuration wherein side walls 18, 20 and end walls 14, 16 are collapsed and folded in an outward orientation. This configuration allows for improved washing of the interior of container 10. With reference now directed to FIG. 11, shown therein is container 10 having side walls 18, 20 and end walls 14, 16 oriented in an inwardly collapsed position. As FIG. 11 indicates, the design according to the present invention allows container 10 to be compactly folded for storage and transport. In this orientation, side walls 18, 20 are pivoted inward via hinging system 58 and folded in a layered fashion on top of base 12. Subsequently, end walls 14, 16 are folded inward on top of side walls 18, 20 via hinging system 60.

The capability of placing containers 10 in a stacked configuration when in the inwardly folded position minimizes the vertical space required to store empty containers 10. FIGS. 2 and 7 show the bottom surface 94 of base 12 and illustrate features which permit an inwardly collapsed container 10 to be stacked on top of a like folded container so that the resulting stack is stable. In particular, bottom surface 94 includes foot tabs 95 which are sized to be securely received by recesses 96 formed in the upper edge of container 10. Container 10 can be stacked directly above a like container such that each of the plurality of foot tabs 95 of the upper container are aligned with and are received within the corresponding recesses 96 of the lower container 10. Such alignment between foot tabs 95 and recesses 96 provides additional stability and alignment to container 10 when placed in a stacked orientation with a like container.

Figure 18:
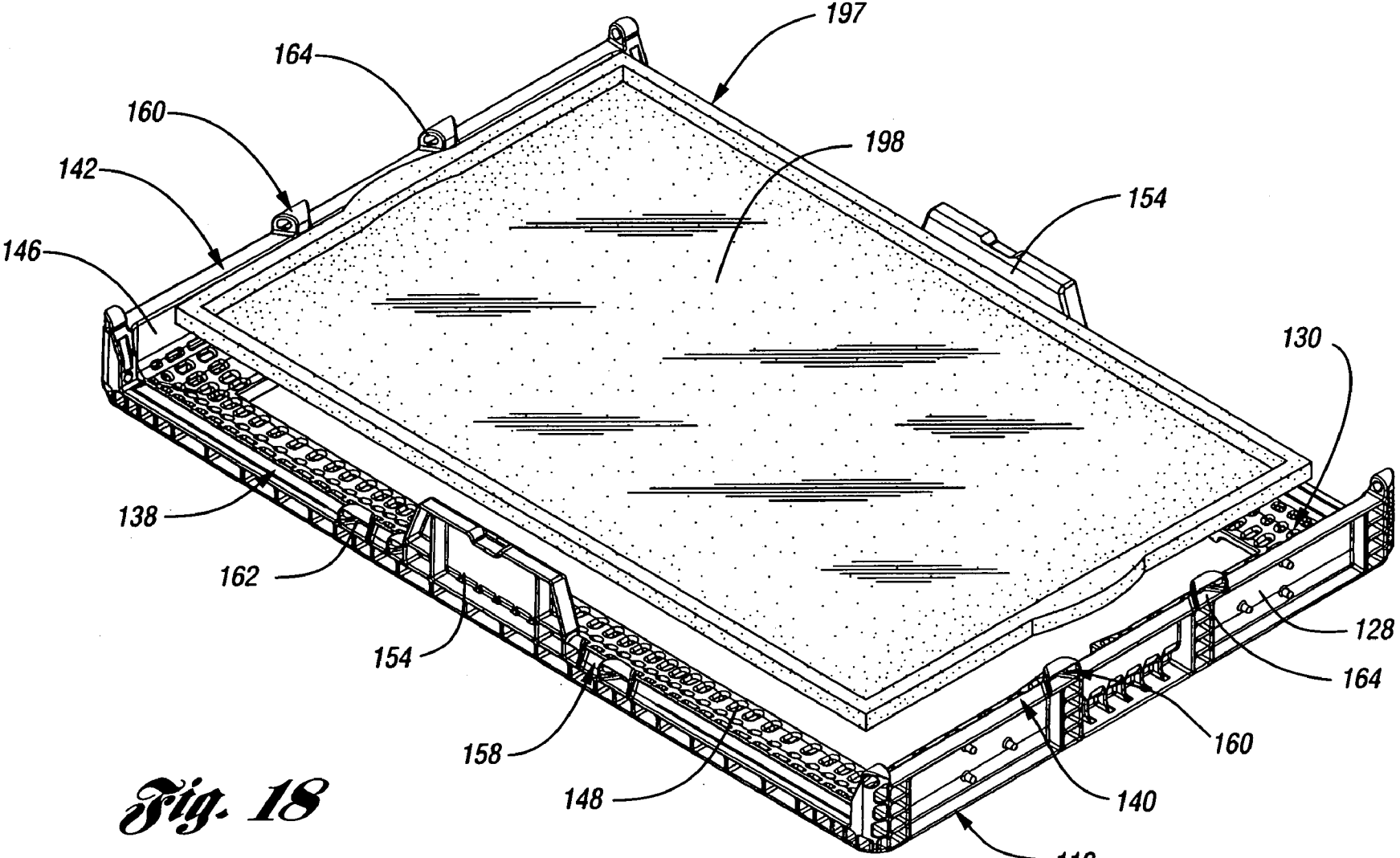
FIG. 18 is an exploded perspective view of the base of FIG. 15 and an exterior ring.
Figure 19:
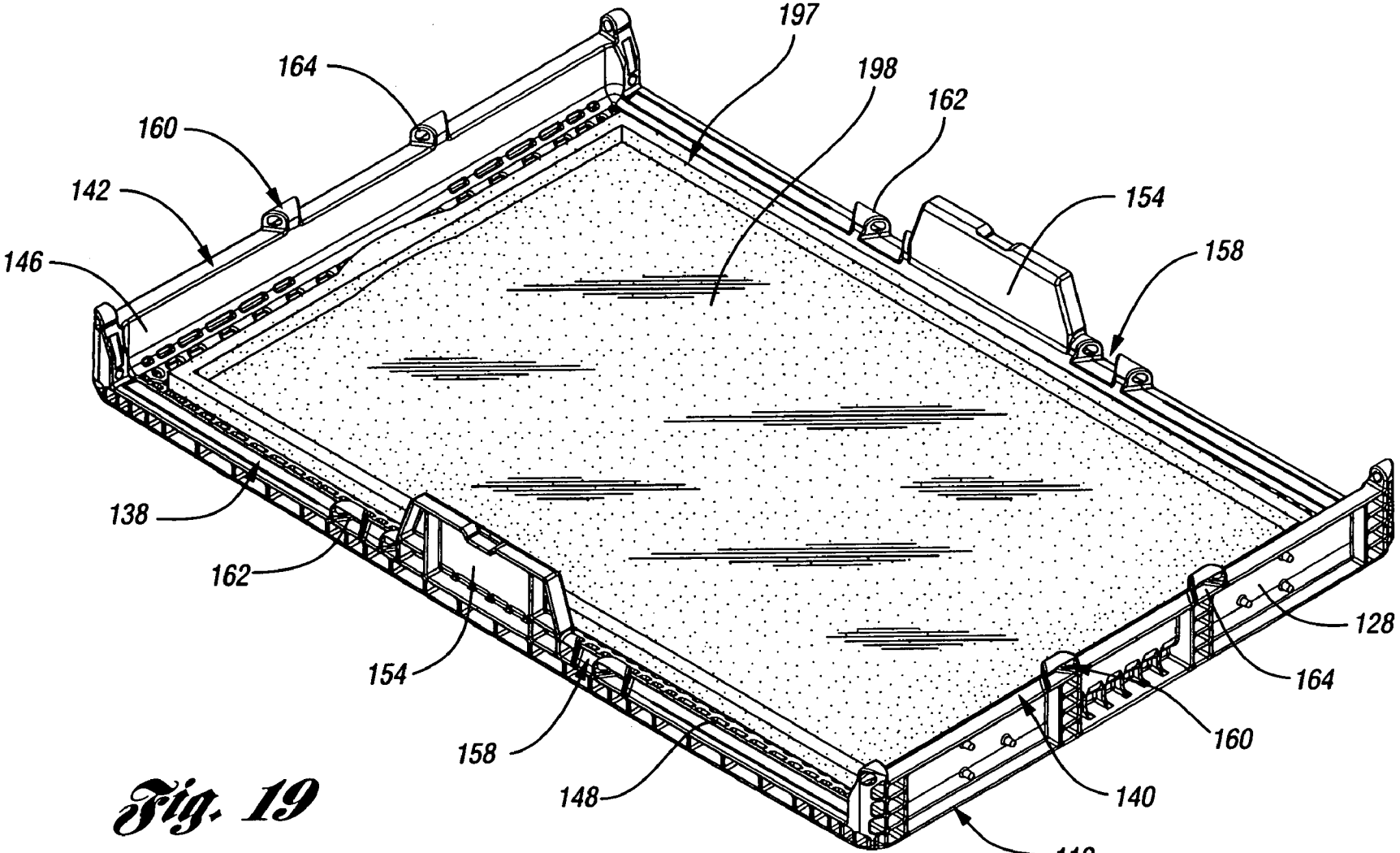
FIG. 19 is an assembly perspective view of the base of FIG. 15 shown supporting the exterior ring.
Figure 20:
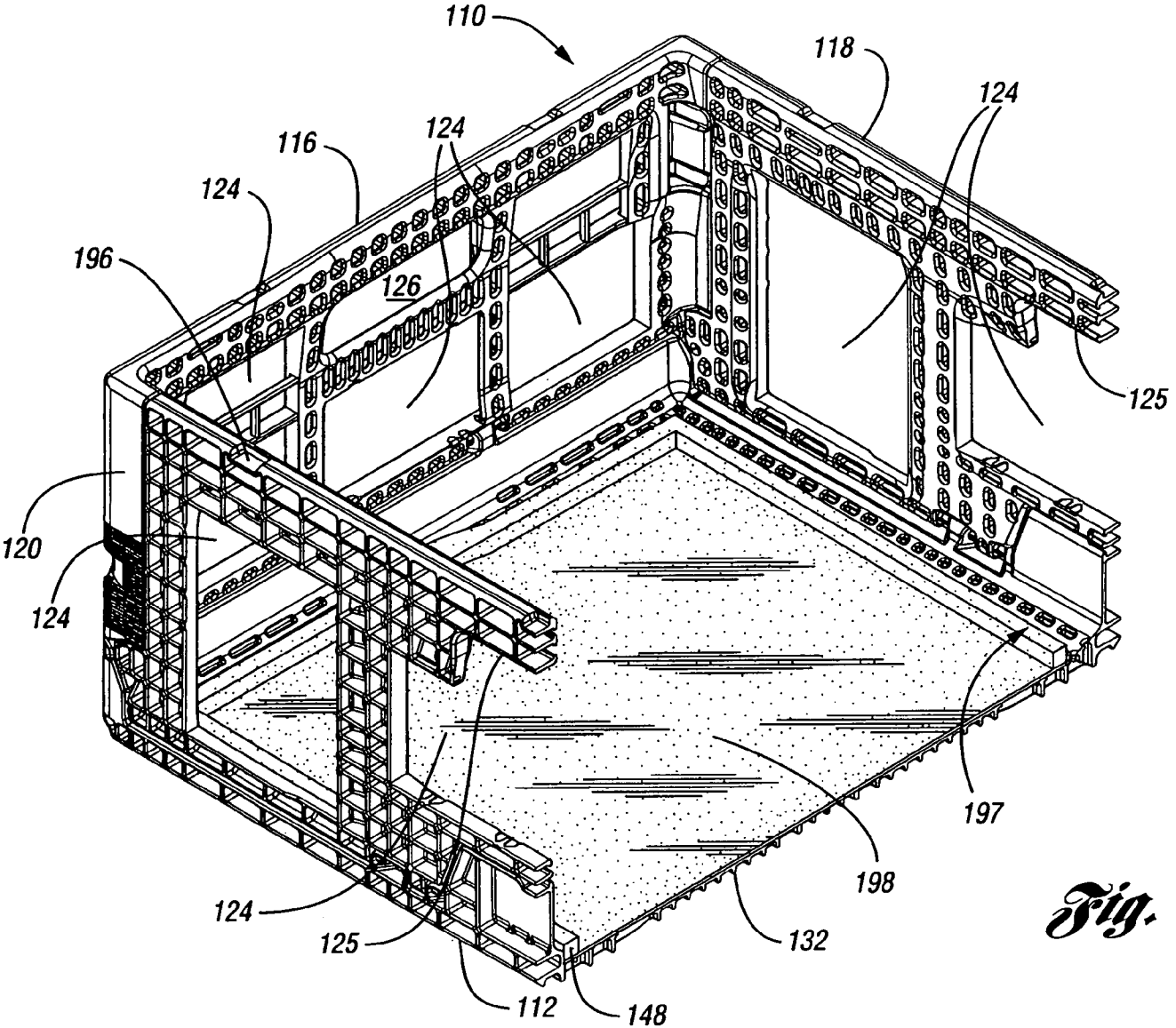
FIG. 20 is a partial perspective view of a second embodiment of the container constructed with the base of FIG. 15 and the exterior ring of FIGS. 18–19 which includes support material extending thereacross.

With reference to FIGS. 15–20, a second embodiment of a container according to the present invention is illustrated which is substantially similar to container 10 except for an alternative base configuration. The reference numerals for FIGS. 15–20 correspond generally with the reference numerals for FIGS. 1–14 except for the addition of a "1" prefix. In this embodiment, and with reference to FIGS. 18–20, the base member of container 110 includes an exterior ring 197 and a lightweight support material 198 affixed thereacross. Lightweight support material can include, for example, such plastic materials as a flexible film, mesh, or netting or, alternatively, a paper material. It is further contemplated that support material 198 may alternatively be a more rigid plastic member, plexiglass, wood, or corrugated cardboard, without departing from the teachings according to the present invention. Advantageously, lightweight support material 198 provides shock absorption for protecting produce during transport. As depicted in FIGS. 18–20, exterior ring 197 is adapted to be supported by, and releasably attached to, inwardly extending flange 148 of peripheral frame portion 130. Exterior ring 197 is preferably constructed to be reusable, while support material 198 is designed to be disposable. While two particular constructions for the base member have been illustrated and described herein, it is understood that the base member is interchangeable with any structure suitable for the intended purpose.

Turning now to FIGS. 21–24, a third embodiment of the container according to the present invention is illustrated. The reference numerals for FIGS. 21–24 correspond generally with the reference numerals for FIGS. 1–14 except for the addition of a "2" prefix. Container 210 includes end walls 214, 216 and side walls 218, 220 which are integrally joined with base 212 and extend upwardly therefrom. End walls 214, 216 and side walls 218, 220 are also integrally joined with each other such that end walls 214, 216, side walls 218, 220, and base 212 together define a compartment area 222 for receiving the inner receptacle therein. Container 210 may also be designed to be collapsible, as in the first or second embodiments shown and described herein.

Figure 21:
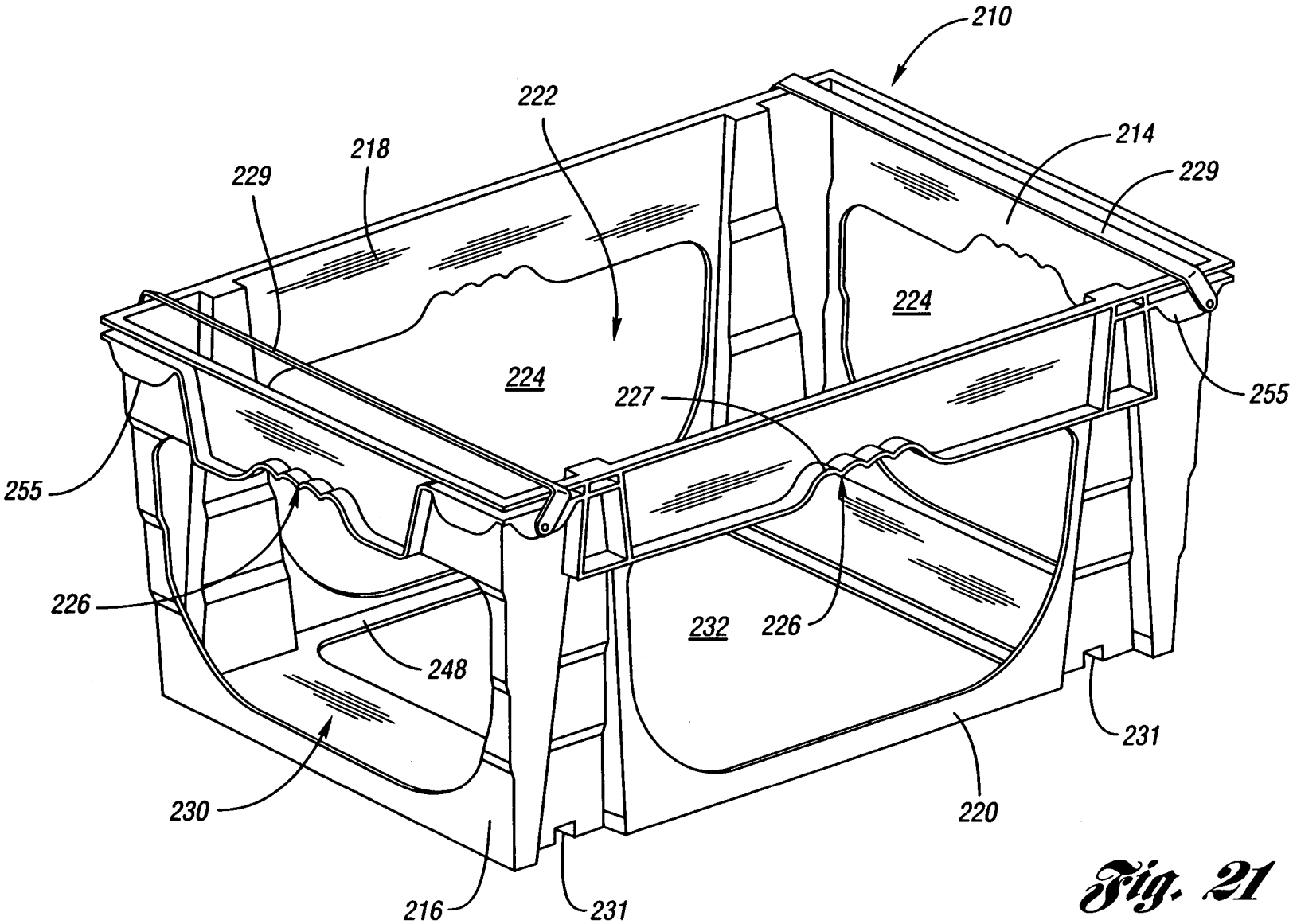
FIG. 21 is a perspective view of a third embodiment of a container according to the present invention.
Figure 22:
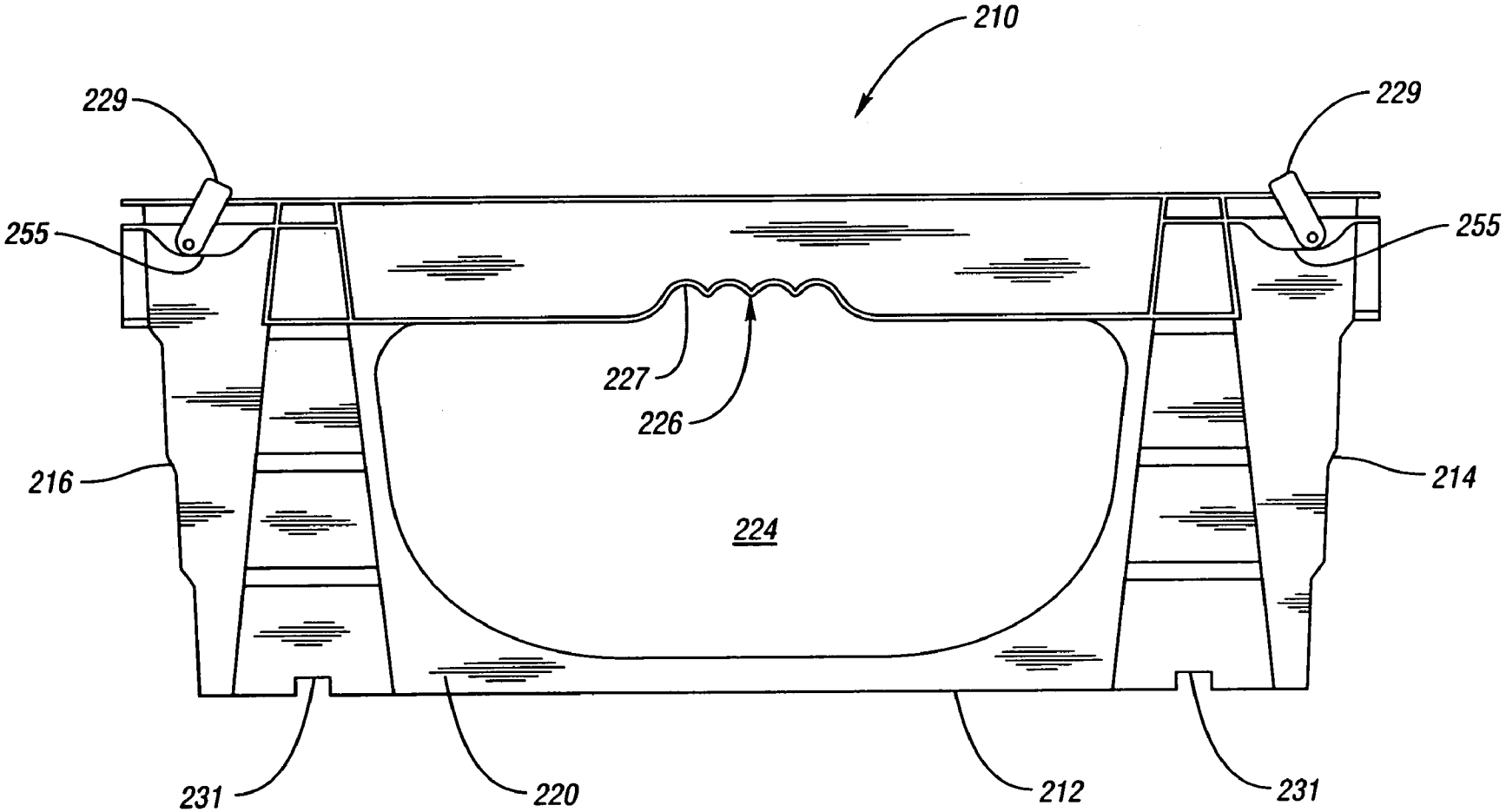
FIG. 22 is a side elevational view of the container of FIG. 21.

Similar to the walls of container 10 and 110, side walls 218, 220 and end walls 214, 216 include a plurality of relatively large apertures 224 which represent a substantial portion of the walls 214, 216, 218, 220. Furthermore, end walls 214, 216 and side walls 218, 220 each include integral handles 226 formed therein. As shown in FIGS. 21 and 22, handles 226 can include scallops 227 formed therein to receive a user's fingers and aid in carrying container 210. Still further, container 210 can be provided with bail arms 229 which are pivotably attached to side walls 218, 220 (as shown in FIGS. 21 and 22) or end walls 214, 216. Bail arms 229 can be rotated inwardly (as shown) toward the interior of container 210 to provide a surface for container 210 to be stacked upon a similar lower container. When stacked, receiving notches 231 provided in base 212 of container 210 are sized to receive bail arms 229 of the lower container therein. Bail arms 229 can also be rotated outwardly toward the edge of container 210 to allow container 210 to be placed in a nested configuration with a similar container.

Figure 23:
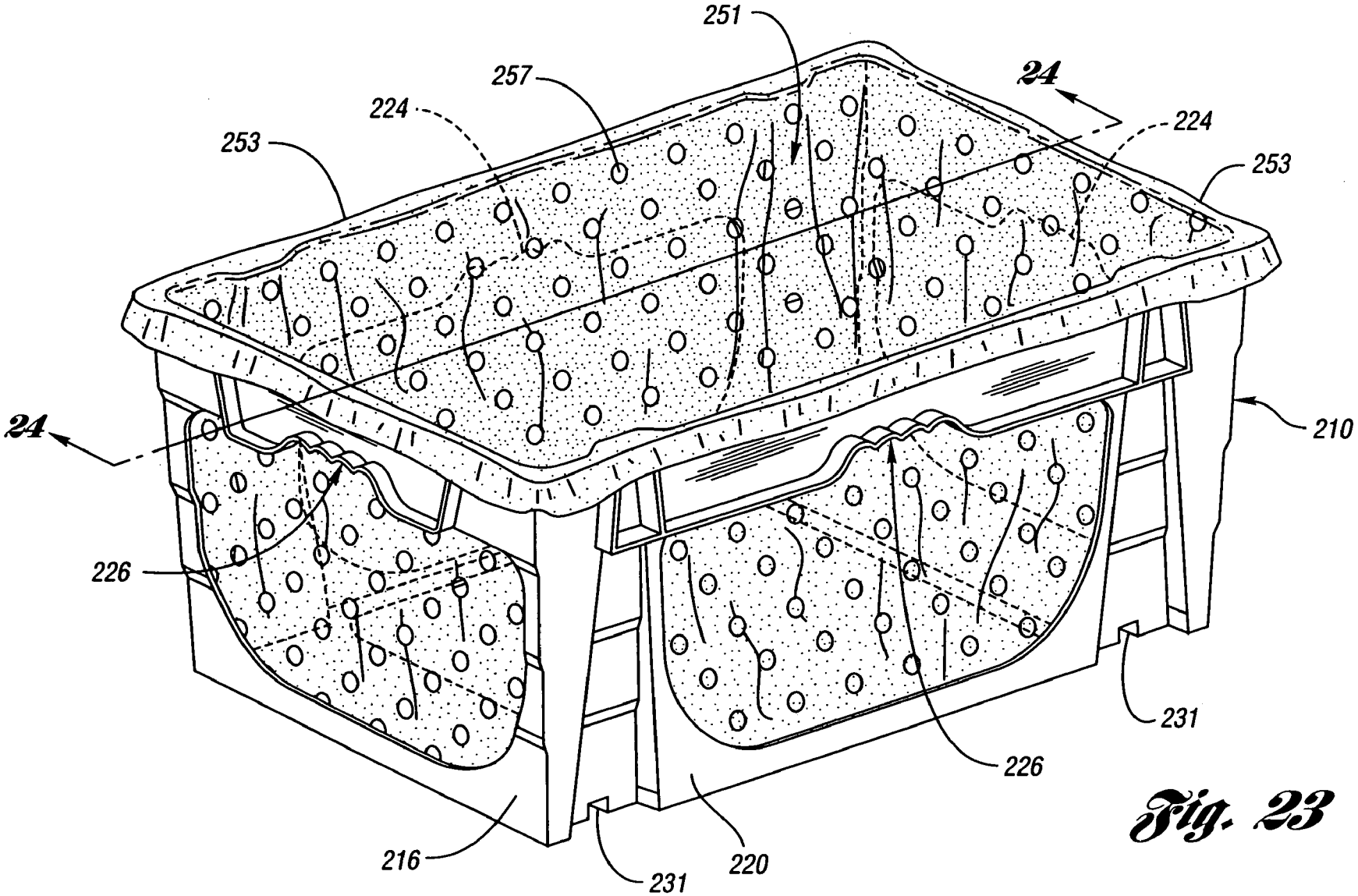
FIG. 23 is a perspective view of the container of FIG. 21 shown in assembly with an inner bag.
Figure 24:
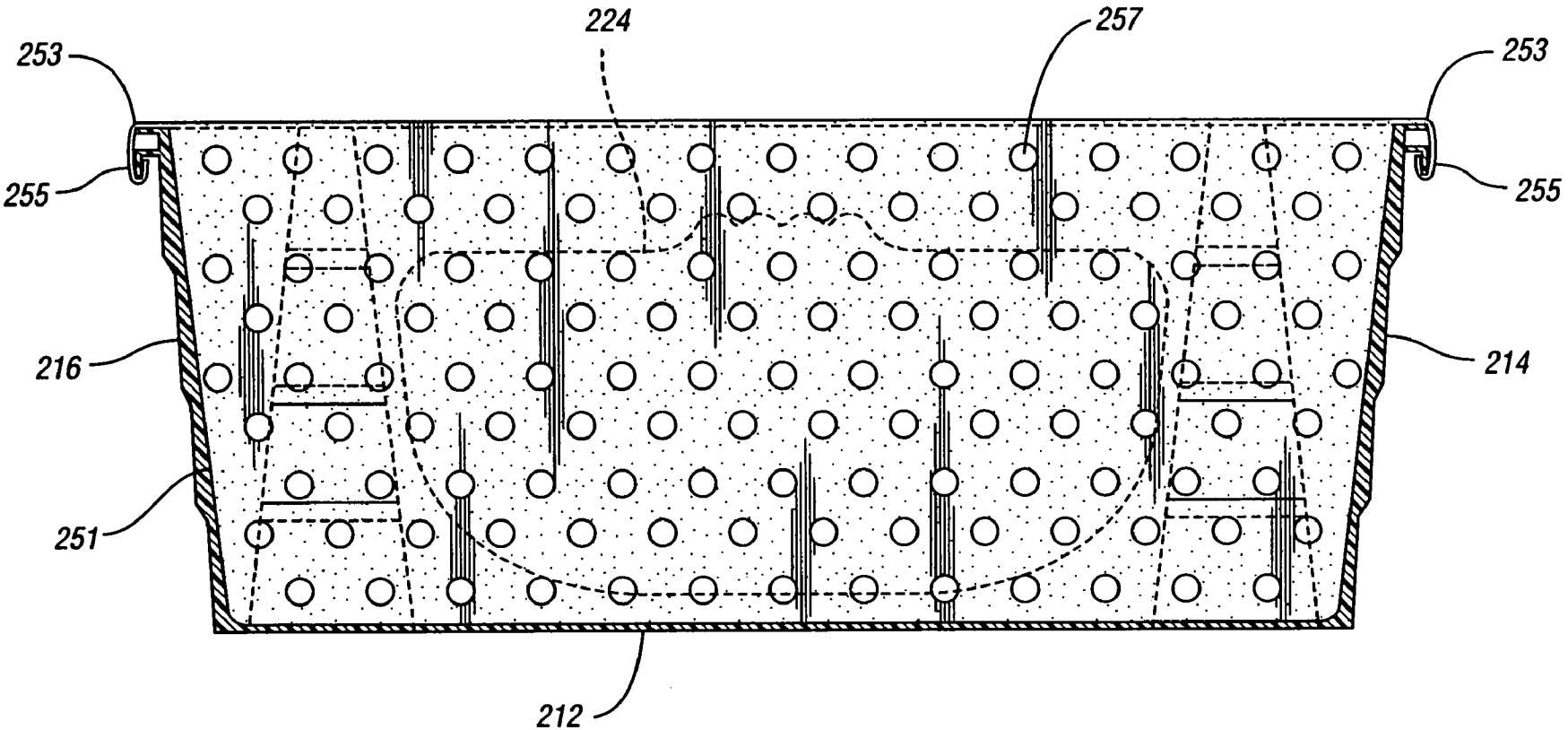
FIG. 24 is a cross-sectional view taken along line 24—24 of FIG. 23 showing the container of FIG. 21 in assembly with an inner bag.

In the embodiment shown in FIGS. 21–24, the inner receptacle includes a bag 251. The flexibility of bag 251 helps to absorb vibrations due to handling, thereby reducing damage to the contents being transported. As shown in FIGS. 23 and 24, bag 251 is placed in container 210, and its free ends 253 are extended upwardly and above the upper edge of side walls 218, 220 and end walls 214, 216. Free ends 253 can then simply be cuffed over the upper edge of side walls 218, 220 and end walls 214, 216 and used to display graphics or other indicia for merchandising or identification purposes. In a collapsible embodiment, cuffing free ends 253 of bag 251 over walls 214, 216, 218, 220 can also serve to secure walls 214, 216, 218, 220 in the assembled position. In the embodiment shown, free ends 253 are secured to container 210 using attachment members 255, such as bag hooks, provided on the exterior of side walls 218, 220 and end walls 214, 216. Alternatively, attachment members 255 could be provided on the interior of side walls 218, 220 and/or end walls 214, 216. Attachment members 255 can be used to suspend bag 251 within compartment area 222. Of course, attachment members 255 can also be provided for the first and second embodiments of container 10, 110.

As shown in FIGS. 23 and 24, bag 251 includes ventilation apertures 257 which can have any configuration desired and suitable for the particular product transported and stored within container 210. Bag 251 can be constructed from materials such as plastic film, mesh, or paper, and is preferably designed to closely correspond to the inside dimensions of container 210. An insert, such as a generally rigid sheet material (not shown), can be inserted into bag 251 to provide shape, structure, and rigidity, and to force bag 251 outwardly toward walls 214, 216, 218, 220 of container 210.

Of course, it is understood that other inner receptacles are interchangeable with the box 50 and bag 251 embodiments shown and described herein.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A container adapted to receive an inner receptacle, the container comprising:

a base for supporting a lower portion of the inner receptacle, the base including a peripheral frame portion defining at least one relatively large opening therebetween;

a first pair of opposed walls pivotably attached to the peripheral frame portion and movable between an assembled position and an inwardly collapsed position;

a second pair of opposed walls pivotably attached to the peripheral frame portion and movable between an assembled position and an inwardly collapsed position, each of the second pair of opposed walls releasably attached to an adjacent one of the first pair of opposed walls, wherein the assembled first and second pairs of opposed walls and the base define a compartment area which is arranged to removably receive the inner receptacle therein.

2. The container according to claim 1, wherein the peripheral frame portion includes an inwardly extending flange for supporting the lower portion of the inner receptacle.

3. The container according to claim 1, further comprising a base member extending across the relatively large opening.

4. The container according to claim 3, wherein the base member includes at least one cross-member attached to the peripheral frame portion.

5. The container according to claim 3, wherein the base member includes an exterior ring and a lightweight support material affixed thereacross, the exterior ring adapted to be supported by an inwardly extending flange of the peripheral frame portion.

6. The container according to claim 1, wherein the first and second pairs of opposed walls include a plurality of relatively large apertures which represent a substantial portion of each of the first and second pairs of opposed walls.

7. The container according to claim 1, wherein at least one of the first and second pairs of opposed walls includes attachment members for securing the inner receptacle to the opposed walls.

8. The container according to claim 1, wherein at least one of the first and second pairs of opposed walls includes an integral handle.

9. The container according to claim 1, wherein one of the first and second pairs of opposed walls includes bail arms pivotably attached thereto.

10. The container according to claim 1, wherein one of the first and second pairs of opposed walls includes a guide projection and the other includes a guide receiver for aligning the first and second pairs of opposed walls in the assembled position.

11. The container according to claim 1, wherein one of the first and second pairs of opposed walls includes a latch and the other includes a latch receiver for securing the first and second pairs of opposed walls in the assembled position.

12. A container adapted to receive an inner receptacle, comprising:

a base including a peripheral frame portion;

a base member adapted to be received on the peripheral frame portion for supporting a lower portion of the inner receptacle, the base member including an exterior ring and a lightweight support material affixed thereacross;

a first pair of opposed walls extending upwardly from the peripheral frame portion; and a second pair of opposed walls extending upwardly from the peripheral frame portion and attached to the first pair of opposed walls, wherein the first and second pairs of opposed walls and the base define a compartment area for receiving the inner receptacle therein.

13. The container according to claim 12, wherein the exterior ring is adapted to be supported by an inwardly extending flange of the peripheral frame portion.

14. The container according to claim 12, wherein the exterior ring is releasably attached to the peripheral frame portion.

15. The container according to claim 12, wherein the first and second pairs of opposed walls include a plurality of relatively large apertures which represent a substantial portion of each of the first and second pairs of opposed walls.

16. The container according to claim 12, wherein at least one of the first and second pairs of opposed walls includes attachment members for securing the inner receptacle within the compartment area.

17. The container according to claim 12, wherein the first and second pairs of opposed walls are each pivotably attached to the peripheral frame portion and releasably attached to each other, such that the first and second pairs of opposed walls are orientable between an assembled position and a collapsed position.

18. A collapsible container adapted to receive an inner receptacle, the container comprising:

a base for supporting a lower portion of the inner receptacle, the base having a peripheral frame portion defining at least one relatively large opening therebetween;

a first pair of opposed walls pivotably attached to the peripheral frame portion and movable between an assembled position and an inwardly collapsed position, each of the first pair of opposed walls having a flange depending inwardly therefrom; and a second pair of opposed walls pivotably attached to the peripheral frame portion and movable between an assembled position and an inwardly collapsed position, each of the second pair of opposed walls releasably attached to the flange of an adjacent one of the first pair of opposed walls in the assembled position, wherein orienting the first and second pairs of opposed walls in the assembled position defines a compartment area which is arranged to removably receive the inner receptacle therein.

19. The container according to claim 18, wherein one of the first and second pairs of opposed walls includes a guide projection and the other includes a guide receiver for aligning the first and second pairs of opposed walls in the assembled position.

20. The container according to claim 18, wherein one of the first and second pairs of opposed walls includes a latch and the other includes a latch receiver for securing the first and second pairs of opposed walls in the assembled position.

21. The collapsible container according to claim 20, wherein the latch receiver is disposed within the flange depending inwardly from each of the first pair of opposed walls, the latch receiver having a latch aperture and a user actuable release portion, wherein the latch aperture is sized for slidingly receiving the corresponding latch when the container is oriented in the assembled position, such that to release the container from the assembled position, the user actuable release portion is actuated by a user to release the latch from the latch aperture.

22. The collapsible container according to claim 18, wherein the peripheral frame portion includes an inwardly extending flange for supporting the lower portion of the inner receptacle.

23. The collapsible container according to claim 18, further comprising a base member extending across the relatively large opening.

24. The collapsible container according to claim 23, wherein the base member includes at least one cross-member attached to the peripheral frame portion.

25. The collapsible container according to claim 23, wherein the base member includes an exterior ring and a lightweight support material affixed thereacross, the exterior ring adapted to be supported by an inwardly extending flange of the peripheral frame portion.

26. The collapsible container according to claim 18, wherein at least one of the first and second pairs of opposed walls includes attachment members for securing the inner receptacle to the opposed walls.

* * * * *